US007798257B2

(12) United States Patent
Shen et al.

(10) Patent No.: US 7,798,257 B2
(45) Date of Patent: Sep. 21, 2010

(54) SHAPED CUTTER SURFACE

(75) Inventors: Yuelin Shen, Houston, TX (US); Youhe Zhang, Tomball, TX (US); Zhou Yong, Spring, TX (US)

(73) Assignee: Smith International, Inc., Houston, TX (US)

( * ) Notice: Subject to any disclaimer, the term of this patent is extended or adjusted under 35 U.S.C. 154(b) by 89 days.

(21) Appl. No.: 11/117,650

(22) Filed: Apr. 28, 2005

(65) Prior Publication Data

US 2005/0269139 A1 Dec. 8, 2005

Related U.S. Application Data

(60) Provisional application No. 60/584,307, filed on Jun. 30, 2004, provisional application No. 60/566,751, filed on Apr. 30, 2004, provisional application No. 60/648,863, filed on Feb. 1, 2005.

(51) Int. Cl.
*E21B 10/42* (2006.01)

(52) U.S. Cl. ..... 175/430; 175/431

(58) Field of Classification Search ..... 175/426, 175/428, 431, 434, 430
See application file for complete search history.

(56) References Cited

U.S. PATENT DOCUMENTS

| | | | | |
|---|---|---|---|---|
| 3,745,623 | A | 7/1973 | Wentorf et al. | |
| 4,108,260 | A | 8/1978 | Bozarth | |
| 4,334,586 | A | 6/1982 | Schumacher | |
| 4,570,726 | A | 2/1986 | Hall | |
| 4,984,642 | A * | 1/1991 | Renard et al. | 175/430 |
| 5,010,789 | A * | 4/1991 | Brett et al. | 76/108.2 |
| 5,332,051 | A | 7/1994 | Knowlton | |
| 5,415,244 | A * | 5/1995 | Portwood | 175/374 |
| 5,437,343 | A | 8/1995 | Cooley et al. | |
| 5,443,565 | A * | 8/1995 | Strange, Jr. | 175/431 |
| 5,662,183 | A | 9/1997 | Fang | |
| 5,813,485 | A * | 9/1998 | Portwood | 175/430 |
| 5,871,060 | A * | 2/1999 | Jensen et al. | 175/420.2 |
| 6,053,263 | A * | 4/2000 | Meiners | 175/331 |
| 6,059,054 | A * | 5/2000 | Portwood et al. | 175/430 |
| 6,199,645 | B1 * | 3/2001 | Anderson et al. | 175/426 |
| 6,202,770 | B1 * | 3/2001 | Jurewicz et al. | 175/428 |
| 6,227,318 | B1 * | 5/2001 | Siracki | 175/430 |

(Continued)

FOREIGN PATENT DOCUMENTS

| | | |
|---|---|---|
| GB | 2307933 | 6/1997 |

(Continued)

OTHER PUBLICATIONS

Combined Search and Examination Report, 8 pages.

(Continued)

*Primary Examiner*—Kenneth Thompson
*Assistant Examiner*—David Andrews
(74) *Attorney, Agent, or Firm*—Christie, Parker & Hale, LLP

(57) ABSTRACT

A cutter for a drill bit used in a geological formation includes a shaped ultra hard working surface. The cutter with the shaped working surface is mounted on a drill bit to provide desired cutting characteristics. The shaped working surface provides varied cutting characteristics depending upon the shape, and the characteristics can vary depending upon the depth of the cut.

39 Claims, 22 Drawing Sheets

U.S. PATENT DOCUMENTS

| | | | | |
|---|---|---|---|---|
| 6,308,790 | B1 * | 10/2001 | Mensa-Wilmot et al. | 175/73 |
| 6,550,556 | B2 | 4/2003 | Middlemiss et al. | |
| 6,883,624 | B2 * | 4/2005 | McDonough | 175/428 |
| 6,904,984 | B1 * | 6/2005 | Estes et al. | 175/430 |
| 6,929,079 | B2 * | 8/2005 | McDonough et al. | 175/420.1 |
| 7,013,999 | B2 * | 3/2006 | Tufts | 175/430 |
| 7,631,709 | B2 * | 12/2009 | McDonough et al. | 175/430 |
| 2005/0263327 | A1 * | 12/2005 | Meiners et al. | 175/430 |
| 2006/0011388 | A1 * | 1/2006 | Boudrare et al. | 175/311 |

FOREIGN PATENT DOCUMENTS

| | | |
|---|---|---|
| SU | 791889 | 12/1980 |

OTHER PUBLICATIONS

Abstract of SU791889, 1 page.

Official Action issued in corresponding Canadian Patent Application No. 2,505,710 dated May 5, 2006; 3 pages.

* cited by examiner

FIG. 11
FIG. 12
FIG. 13
FIG. 14
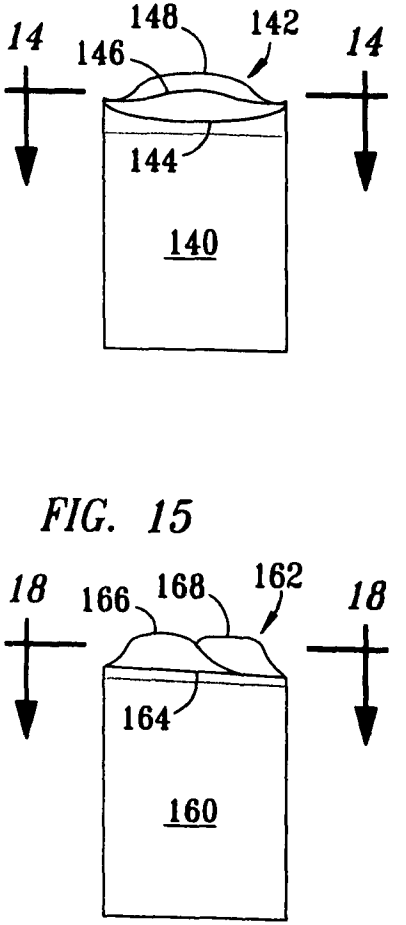
FIG. 15
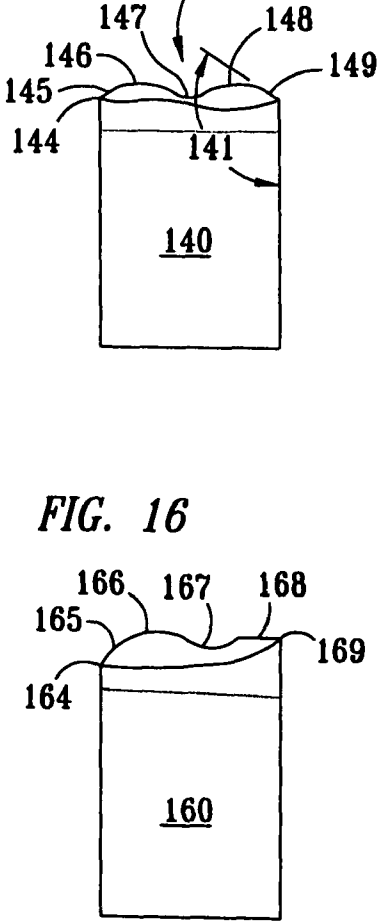
FIG. 16
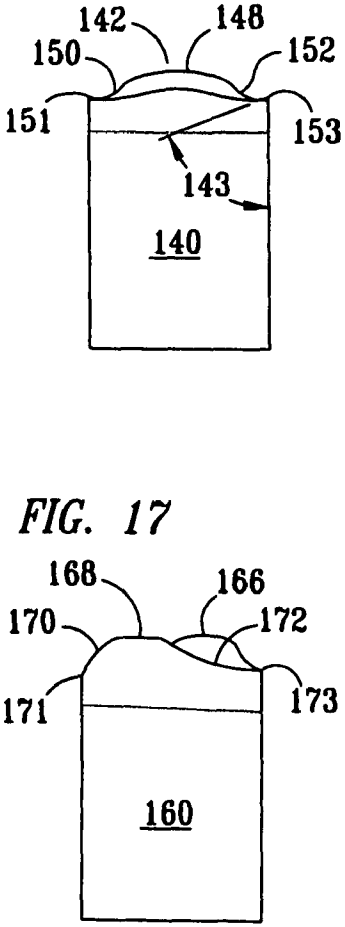
FIG. 17
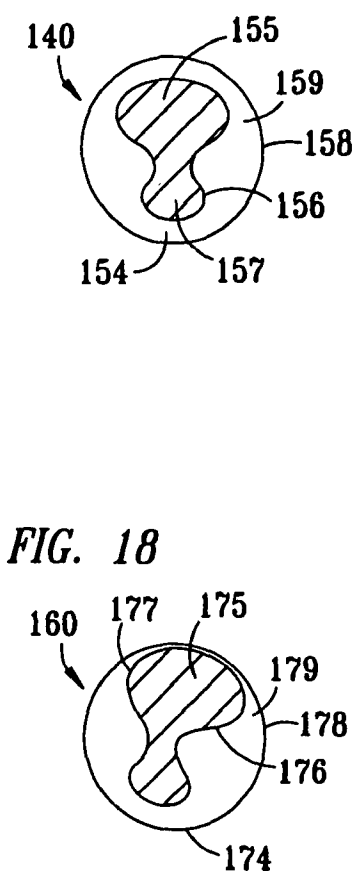
FIG. 18

25
29
190
194
195
196
198
199
200
201
202
203
204
205
206
207
208
209
210
212
214
215
216
217
218
219
221
222
223
224
225
226
227
228
229
192

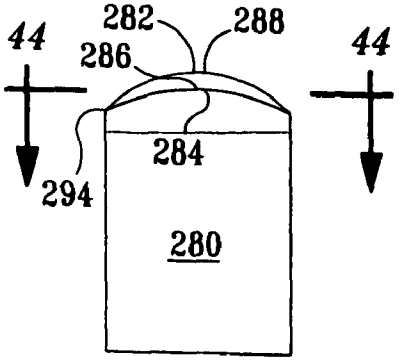
FIG. 41
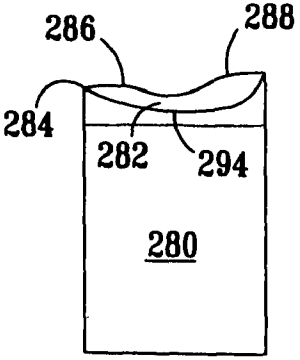
FIG. 42
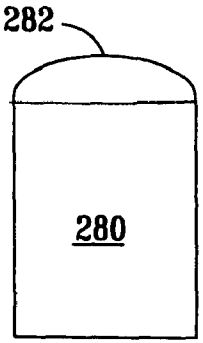
FIG. 43
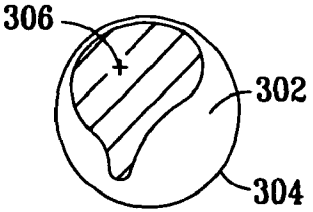
FIG. 44
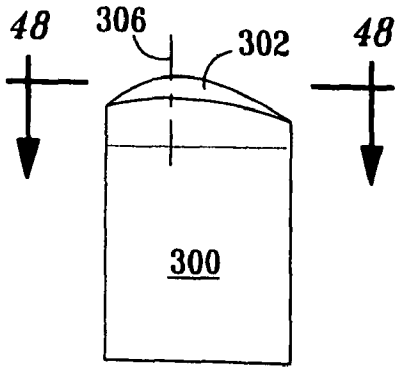
FIG. 45
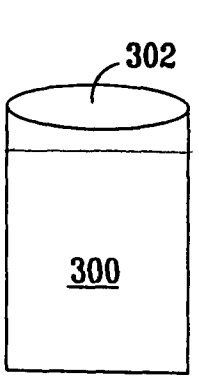
FIG. 46
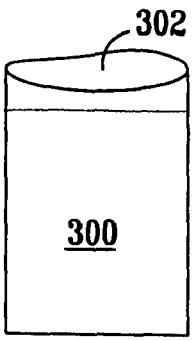
FIG. 47
FIG. 48

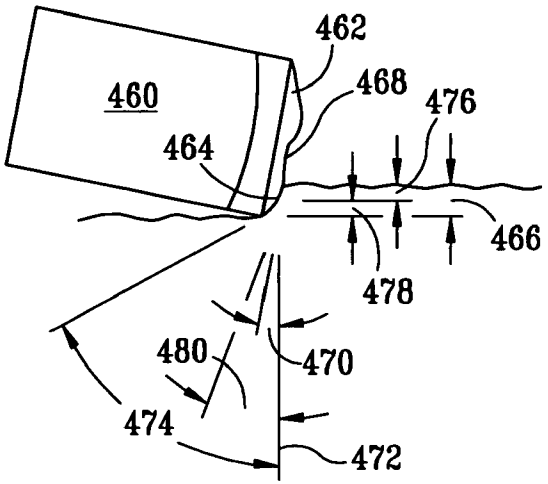
FIG. 67
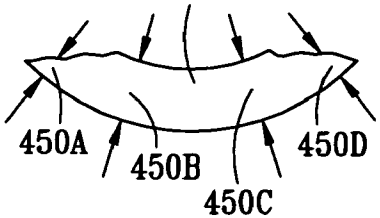
FIG. 68
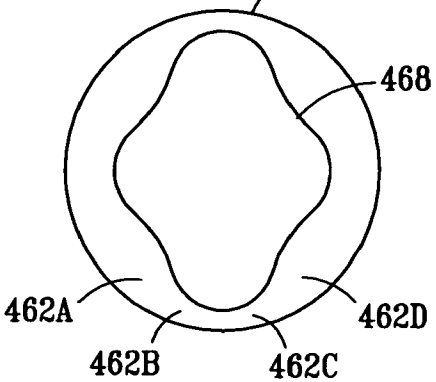
FIG. 69
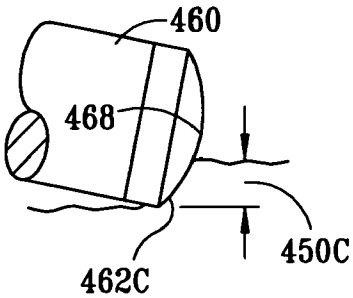
FIG. 70A
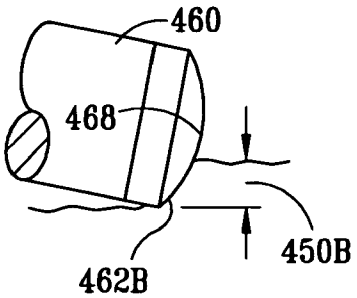
FIG. 70B
FIG. 70C
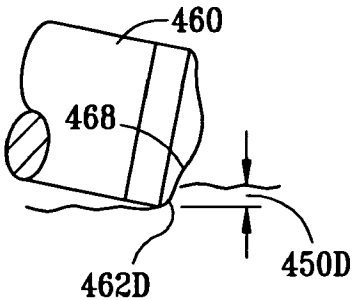
FIG. 70D

SHAPED CUTTER SURFACE

This application claims priority, pursuant to 35 U.S.C. §119(e), to U.S. Provisional Patent Application No. 60/566,751 filed Apr. 30, 2004, U.S. Provisional Patent Application No. 60/584,307 filed Jun. 30, 2004, and U.S. Provisional Patent Application No. 60/648,863, filed Feb. 1, 2005. Those applications are incorporated by reference in their entireties.

BACKGROUND OF INVENTION

1. Field of the Invention

The invention relates generally to drill bits in the oil and gas industry, particularly to drill bits having cutters or inserts having hard and ultra hard cutting surfaces or tables and to cutters or inserts for drill bits such as drag bits and, more particularly, to cutters and inserts with ultra hard shaped working surfaces made from materials such as diamond material, polycrystalline diamond material, or other ultra hard material bonded to a substrate and/or to a support stud.

2. Background Art

Rotary drill bits with no moving elements on them are typically referred to as "drag" bits. Drag bits are often used to drill a variety of rock formations. Drag bits include those having cutters (sometimes referred to as cutter elements, cutting elements or inserts) attached to the bit body. For example, the cutters may be formed having a substrate or support stud made of cemented carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1. The drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus the working surface 20 and the side surface 21 meet or intersect to form a circumferential cutting edge 22. Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultra hard cutter is to be used, the bit body 12 may be made from powdered tungsten carbide (WC) infiltrated with a binder alloy within a suitable mold form. In one manufacturing process the crown 26 includes a plurality of holes or pockets 34 that are sized and shaped to receive a corresponding plurality of cutters 18. The combined plurality of cutting edges 22 of the cutters 18 effectively forms the cutting face of the drill bit 10. Once the crown 26 is formed, the cutters 18 are positioned in the pockets 34 and affixed by any suitable method, such as brazing, adhesive, mechanical means such as interference fit, or the like. The design depicted provides the pockets 34 inclined with respect to the surface of the crown 26. The pockets are inclined such that cutters 18 are oriented with the working face 20 generally perpendicular to the axis 19 of the cutter 18 and at a desired rake angle in the direction of rotation of the bit 10, so as to enhance cutting. It will be understood that in an alternative construction (not shown), the can each be substantially perpendicular to the surface of the crown, while an ultra hard surface is affixed to a substrate at an angle on a cutter body or a stud so that a desired rake angle is achieved at the working surface.

A typical cutter 18 is shown in FIG. 2. The typical cutter has a cylindrical cemented carbide substrate body 38 having an end face or upper surface 54 referred to herein as the "interface surface" 54. An ultra hard material layer 44, such as polycrystalline diamond or polycrystalline cubic boron nitride layer, forms the working surface 20 and the cutting edge 22. A bottom surface 52 of the cutting layer 44 is bonded on to the upper surface 54 of the substrate 38. The joining surfaces 52 and 54 are herein referred to as the interface 46. The top exposed surface or working surface 20 of the cutting layer 44 is opposite the bonded surface 52. The cutting layer 44 typically has a flat or planar working surface 20, but may also have a curved exposed surface, that meets the side surface 21 at a cutting edge 22.

Cutters may be made, for example, according to the teachings of U.S. Pat. No. 3,745,623, whereby a relatively small volume of ultra hard particles such as diamond or cubic boron nitride is sintered as a thin layer onto a cemented tungsten carbide substrate. Flat top surface cutters as shown in FIG. 2 are generally the most common and convenient to manufacture with an ultra hard layer according to known techniques. It has been found that cutter chipping, spalling and delaminating are common failure modes for ultra hard flat top surface cutters.

Generally speaking, the process for making a cutter 18 employs a body of cemented tungsten carbide as the substrate 38 where the tungsten carbide particles are cemented together with cobalt. The carbide body is placed adjacent to a layer of ultra hard material particles such as diamond or cubic boron nitride particles and the combination is subjected to high temperature at a pressure where the ultra hard material particles are thermodynamically stable. This results in recrystallization and formation of a polycrystalline ultra hard material layer, such as a polycrystalline diamond or polycrystalline cubic boron nitride layer, directly onto the upper surface 54 of the cemented tungsten carbide substrate 38.

It has been found by applicants that many cutters develop cracking, spalling, chipping and partial fracturing of the ultra hard material cutting layer at a region of cutting layer subjected to the highest loading during drilling. This region is referred to herein as the "critical region" 56. The critical region 56 encompasses the portion of the cutting layer 44 that makes contact with the earth formations during drilling. The critical region 56 is subjected to the generation of high magnitude stresses from dynamic normal loading, and shear loadings imposed on the ultra hard material layer 44 during drilling. Because the cutters are typically inserted into a drag bit at a rake angle, the critical region includes a portion of the ultra hard material layer near and including a portion of the layer's circumferential edge 22 that makes contact with the earth formations during drilling. The high magnitude stresses at the critical region 56 alone or in combination with other factors, such as residual thermal stresses, can result in the initiation and growth of cracks 58 across the ultra hard layer 44 of the cutter 18. Cracks of sufficient length may cause the separation of a sufficiently large piece of ultra hard material, rendering the cutter 18 ineffective or resulting in the failure of the cutter 18. When this happens, drilling operations may have to be ceased to allow for recovery of the drag bit and replacement of the ineffective or failed cutter. The high stresses, particularly shear stresses, can also result in delamination of the ultra hard layer 44 at the interface 46.

One type of ultra hard working surface 20 for fixed cutter drill bits is formed as described above with polycrystalline diamond on the substrate of tungsten carbide, typically known as a polycrystalline diamond compact (PDC), PDC cutters, PDC cutting elements or PDC inserts. Drill bits made using such PDC cutters 18 are known generally as PDC bits. While the cutter or cutter insert 18 is typically formed using a cylindrical tungsten carbide "blank" or substrate 38 which is sufficiently long to act as a mounting stud 40, the substrate 38 may also be an intermediate layer bonded at another interface to another metallic mounting stud 40. The ultra hard working surface 20 is formed of the polycrystalline diamond material, in the form of a layer 44 (sometimes referred to as a "table") bonded to the substrate 38 at an interface 46. The top of the ultra hard layer 44 provides a working surface 20 and the bottom of the ultra hard layer 44 is affixed to the tungsten carbide substrate 38 at the interface 46. The substrate 38 or stud 40 is brazed or otherwise bonded in a selected position on the crown of the drill bit body 12 (FIG. 1). As discussed above with reference to FIG. 1, the PDC cutters 18 are typically held and brazed into pockets 34 formed in the drill bit body at predetermined positions for the purpose of receiving the cutters 18 and presenting them to the geological formation at a rake angle.

In order for the body of a drill bit to be resistant to wear, hard and wear-resistant materials such as tungsten carbide are typically used to form the drill bit body for holding the PDC cutters. Such a drill bit body is very hard and difficult to machine. Therefore, the selected positions at which the PDC cutters 18 are to be affixed to the bit body 12 are typically formed during the bit body molding process to closely approximate the desired final shape. A common practice in molding the drill bit body is to include in the mold, at each of the to-be-formed PDC cutter mounting positions, a shaping element called a "displacement." A displacement is generally a small cylinder, made from graphite or other heat resistant materials, which is affixed to the inside of the mold at each of the places where a PDC cutter is to be located on the finished drill bit. The displacement forms the shape of the cutter mounting positions during the bit body molding process. See, for example, U.S. Pat. No. 5,662,183 issued to Fang for a description of the infiltration molding process using displacements.

It has been found by applicants that cutters with sharp cutting edges or small back rake angles provide a good drilling ROP, but are often subject to instability and are susceptible to chipping, cracking or partial fracturing when subjected to high forces normal to the working surface. For example, large forces can be generated when the cutter "digs" or "gouges" deep into the geological formation or when sudden changes in formation hardness produce sudden impact loads. Small back rake angles also have less delamination resistance when subjected to shear load. Cutters with large back rake angles are often subjected to heavy wear, abrasion and shear forces resulting in chipping, spalling, and delaminating due to excessive downward force or weight on bit (WOB) required to obtain reasonable ROP. Thick ultra hard layers that might be good for abrasion wear are often susceptible to cracking, spalling, and delaminating as a result of residual thermal stresses associated with forming thick ultra hard layers on the substrate. The susceptibility to such deterioration and failure mechanisms is accelerated when combined with excessive load stresses.

FIG. 3 shows a prior art PDC cutter held at an angle in a drill bit 10 for cutting into a formation 45. The cutter 18 includes a diamond material table 44 affixed to a tungsten carbide substrate 38 that is bonded into the pocket 34 formed in a drill bit blade 14. The drill bit 10 (see FIG. 1) will be rotated for cutting the inside surface of a cylindrical well bore. Generally speaking, the back rake angle "A" is used to describe the working angle of the working surface 20, and it also corresponds generally to the magnitude of the attack angle "B" made between the working surface 20 and an imaginary tangent line at the point of contact with the well bore. It will be understood that the "point" of contact is actually an edge or region of contact that corresponds to critical region 56 (see FIG. 2) of maximum stress on the cutter 18. Typically, the geometry of the cutter 18 relative to the well bore is described in terms of the back rake angle "A."

Different types of bits are generally selected based on the nature of the geological formation to be drilled. Drag bits are typically selected for relatively soft formations such as sands, clays and some soft rock formations that are not excessively hard or excessively abrasive. However, selecting the best bit is not always straightforward because many formations have mixed characteristics (i.e., the geological formation may include both hard and soft zones), depending on the location and depth of the well bore. Changes in the geological formation can affect the desired type of a bit, the desired ROP of a bit, the desired rotation speed, and the desired downward force or WOB. Where a drill bit is operated outside the desired ranges of operation, the bit can be damaged or the life of the bit can be severely reduced. For example, a drill bit normally operated in one general type of formation may penetrate into a different formation too rapidly or too slowly subjecting it to too little load or too much load. For another example, a drill bit rotating and penetrating at a desired speed may encounter an unexpectedly hard material, possibly subjecting the bit to a "surprise" or sudden impact force. A material that is softer than expected may result in a high rate of rotation, a high ROP, or both, that can cause the cutters to shear too deeply or to gouge into the geological formation. This can place greater loading, excessive shear forces and added heat on the working surface of the cutters. Rotation speeds that are too high without sufficient WOB, for a particular drill bit design in a given formation, can also result in detrimental instability (bit whirling) and chattering because the drill bit cuts too deeply or intermittently bites into the geological formation. Cutter chipping, spalling, and delaminating, in these and other situations, are common failure modes for ultra hard flat top surface cutters.

Dome cutters have provided certain benefits against gouging and the resultant excessive impact loading and instability. This approach for reducing adverse effects of flat surface cutters is described in U.S. Pat. No. 5,332,051. An example of such a dome cutter in operation is depicted in FIG. 4. The prior art cutter 60 has a dome shaped top or working surface 62 that is formed with an ultra hard layer 64 bonded to a substrate 66. The substrate 66 is bonded to a metallic stud 68. The cutter 60 is held in a blade 70 of a drill bit 72 (shown in partial section) and engaged with a geological formation 74

(also shown in partial section) in a cutting operation. The dome shaped working surface 62 effectively modifies the rake angle A that would be produced by the orientation of the cutter 60.

Scoop cutters, as shown at 80 in FIG. 5 (U.S. Pat. No. 6,550,556), have also provided some benefits against the adverse effects of impact loading. This type of prior art cutter 80 is made with a "scoop" or depression 90 formed in the top working surface 82 of an ultra hard layer 84. The ultra hard layer 84 is bonded to a substrate 86 at an interface 88. The depression 90 is formed in the critical region 56. The upper surface 92 of the substrate 86 has a depression 94 corresponding to the depression 90, such that the depression 90 does not make the ultra hard layer 84 too thin. The interface 88 may be referred to as a non-planar interface (NPI). It has been found by applicants that while scoop cutters provide some benefits against the adverse effects of impact loading, additional improvement is desirable.

Diamond cutters provided with single or multiple chamfers with constant, axially symmetrical chamfer geometry (U.S. Pat. No. 5,437,343) have been proposed for reduction of chipping and cracking at the edge of the cutter. In these designs, the size and the angle of each chamfer are constant circumferentially around the cutting edge. It has been found by applicants that while an axially symmetrical shape can provide some additional strength and support to the contact edge at some cutting depth, the cutting efficiency of these cutters may be reduced. Also, with the axially symmetrical shape, the amount of support to the ultra hard layer and the strength of the edge is substantially the same at all depths of cut. Further, the average back rake angle of such prior art cutters does not change significantly with changing depth of cut. It has been found by applicants that increased strength due to a constant size chamfer and axially symmetrical shape does not necessarily counteract the extra proportional increase of loading associated with changes in cutting depth when using cylindrically shaped cutters. This can result in a corresponding increase in cracking, crack propagation, chipping and spalling.

Thus, cutters are desired that can better withstand high loading at the critical region imposed during drilling so as to have an enhanced operating life. Cutters that cut efficiently at designed speed and loading conditions and that regulate the amount of cutting load in changing formations are also desired. Cutters that can direct the flow of chips and reduce balling are desired. In addition, cutters that variably adjust the average back rake angle of the cutter in response to increased cutting depth are further desired.

SUMMARY OF INVENTION

One aspect of the present invention relates to an ultra hard cutter having a central axis, sides, and a shaped top working surface. In one embodiment the shaped working surface includes a smoothly curved surface having two (2) or more relative high points that are asymmetrically positioned about the central axis of the cutter. According to this aspect of the invention, the shaped working surface acts to reduce certain adverse consequences of suddenly increased loading due to changes in the geological formation or in the manner of drill bit operation. The cutter is useful for drill bits used for drilling various types of geological formations.

In certain other embodiments, the ultra hard layer of the cutter forms a shaped working surface or is formed to provide a shaped working surface that has a smoothly curved ridge, the crest of the ridge having at least two different heights. According to this aspect of the invention, the smoothly curved ridge acts to direct cuttings or chips of the geological formation with a shearing action and to either side of the ridge, much like a plow. This tends to reduce certain adverse consequences of chips bonding to the surface, to reduce the WOB, and to improve the thermal conduction of heat away from the cutter and the drill bit. The cutter is useful for drill bits used for drilling various types of geological formations.

According to another aspect of the invention, a cutter has a shaped working surface that includes a first relative peak, or relative high point, inward a short distance from the side of the cutter and adjacent to the intended cutting edge or critical region. A second relative peak, or relative high point, is spaced a second distance from the cutting edge and the first and second relative peaks are interconnected with a smoothly curved concave surface. The shaped working surface facilitates cutting to a first depth in the geological formation with an average back rake angle that varies with the depth of the cut into the geological formation. Particularly, the average back rake angle can be made to increase dramatically with increased depth of cut to increase stability of a drill bit using such cutters. In operation, as the second relative peak begins to engage the geological formation, the average back rake angle is increased due to the shape of the second peak, the WOB increases and the ROP decreases. Thus, when the cutters begin to cut too aggressively or to gouge into the geological formation, the rate of drilling is slowed and stability is increased. Such a shaped working surface can also provide other useful cutting characteristics.

According to another embodiment of the invention, variations in the shaped surface provide various cutting characteristics. According to this aspect of the invention, the shaped working surface is designed so that the area of a cross-section through the working surface is greater than about 20% of the total top surface area of the cutter, where the cross-section is drawn perpendicular to the axis of the cutter and at a height of one half the maximum height from the lowest point on the working surface to the highest point. This provides adequate strength and also allows the shape of the working surface to sufficiently influence the cutting characteristics of the cutter.

According to another embodiment of the invention, variations in the shaped working surface provide various cutting characteristics. According to this aspect of the invention, the shaped working surface is designed so that the perimeter length of a cross-section through the working surface is greater than about 20% of the total circumference of the cutter, where the cross-section is drawn perpendicular to the axis of the cutter and at a height of one half the maximum height from the lowest point on the working surface to the highest point. This provides strength and also allows the shape of the working surface to influence the cutting characteristics of the cutter.

According to another embodiment of the invention, variations in the shaped surface provide various cutting characteristics. According to this aspect of the invention, the shaped working surface is designed so that the area of a cross-section through the working surface is greater than about 50% of the total area of the cutter, where the cross-section is drawn perpendicular to the axis of the cutter and at a height of one half the maximum height from the lowest point on the working surface to the highest point. This provides adequate strength and also allows the shape of the working surface to sufficiently influence the cutting characteristics of the cutter.

According to another embodiment of the invention, variations in the shaped working surface provide various cutting characteristics. According to this aspect of the invention, the shaped working surface is designed so that the perimeter length of a cross-section through the working surface is greater than about 50% of the total circumference of the cutter, where the cross-section is drawn perpendicular to the axis of the cutter and at a height of one half the maximum height from the lowest point on the working surface to the highest point. This provides strength and also allows the shape of the working to influence the cutting characteristics of the cutter.

According to another aspect of the invention, a cutter with a shaped cutter surface having a plurality of rounded relative peaks provides reduced shear forces and also provides additional strength against adverse effects of shear forces. For example, such a shaped cutter surface provides reduced susceptibility to spalling and delaminating.

According to another aspect of the invention, a cutter with a shaped cutter surface having a plurality of axially asymmetrical relative peaks provides additional strength against adverse effects of shear. For example, such a shaped cutter surface provides increased strength to reduce susceptibility to spalling and delaminating.

According to another aspect of the invention, a cutter with a shaped cutter surface that is axially asymmetrical provides improved cutting depth control and improved stabilization of the drill bit against gouging, chattering and vibration during cutting.

According to another aspect of the invention, a non-planar interface is formed between the ultra hard cutter layer and the substrate in a configuration oriented to the shaped working surface to provide support against side shear.

According to another aspect of the invention, a shaped working surface cutter has been discovered to provide controlled cutting direction for directional drilling.

According to another aspect of the invention a drill bit is formed using cutters with shaped working surface to obtain a desired "effective" back rake angle provided by the combined effect of the angle of the top working surface of the cutter at the critical areas at which the cutters engage the formation during drilling.

According to another aspect of the invention the working surface of a cutter is shaped depending upon the position on a drill bit and the predicted shape and depth of profile of the cut of the cutter during drilling.

Other aspects and advantages of the invention will be apparent from the following description and the appended claims.

BRIEF DESCRIPTION OF DRAWINGS

FIG. 11 is a front view of a cutter having an ultra hard shaped working surface, wherein the shape of the working surface has a plurality of rounded relative peaks according to one alternative embodiment of the present invention;

FIG. 12 is a side view of the cutter of FIG. 11;

FIG. 13 is a back view of the cutter of FIG. 11;

FIG. 14 is a top partial section view of the cutter of FIG. 11 taken along a section line 14-14 laterally through the shaped surface halfway between the highest point and the lowest point on the surface;

FIG. 15 is a front view of a cutter having an ultra hard shaped working surface, and wherein the shape of the working surface has a plurality of relative peaks at least one flat and one rounded according to another alternative embodiment of the present invention;

FIG. 16 is a side view of the cutter of FIG. 15;

FIG. 17 is a back view of the cutter of FIG. 15;

FIG. 18 is a top partial section view of the cutter of FIG. 15 taken along a section line 18-18 laterally through the shaped surface halfway between the highest point and the lowest point on the surface;

FIG. 41 is a front view of a cutter of a cutter having an ultra hard shaped working surface, wherein the shape of the working surface has a plurality of relative peaks according to another alternative embodiment of the present invention;

FIG. 42 is a side view of the cutter of FIG. 41;

FIG. 43 is a back view of the cutter of FIG. 41;

FIG. 44 is a top partial section view of the cutter of FIG. 41 taken along a section line 44-44 laterally through the shaped surface halfway between the highest point and the lowest point on the surface;

FIG. 45 is a front view of a cutter having an ultra hard shaped working surface, wherein the shape of the working surface has an axially asymmetrical compound curved shape according to another alternative embodiment of the present invention;

FIG. 46 is a side view of the cutter of FIG. 45;

FIG. 47 is a back view of the cutter of FIG. 45;

FIG. 48 is a top partial section view of the cutter of FIG. 45 taken along a section line 48-48 laterally through the shaped surface halfway between the highest point and the lowest point on the surface;

FIG. 67 is a partial side view of a cutter with a shaped working surface engaged in drilling a formation at a bottom hole and showing a theoretical effective back rake angle produced by the shaped working surface engaged in the formation;

FIG. 68 is a schematic depiction of a predicted cutter/formation engagement pattern for a leading cutter in a dual set drill bit.

FIG. 69 is a top view of the face of an example of a shaped working surface cutter for a leading cutter in a dual set drill bit useful for the cutter/formation pattern according to one embodiment of the invention.

FIGS. 70A-D shows a series of side views of the cutter of FIG. 69 with various portions of the shaped working surface engaged at different depths predicted for the cutter/formation engagement pattern of FIG. 68.

DETAILED DESCRIPTION

Embodiments of the present invention relate to cutters having shaped working surfaces. By using such a structure, the present inventors have discovered that such cutters can better withstand high loading at the critical region imposed during drilling so as to have an enhanced operating life. According to certain aspects of the invention, cutters with shaped working surfaces can cut efficiently at designed speed, penetration and loading conditions, and can compensate for the amount of cutting load in changing formations. Such a shaped cutter surface has been found to increase the strength of the cutter edges in response to increased cutting depth, and according to certain aspects of the invention, to increase the strength of the cutter edges proportionally to the increased load associated with increased depth of cutting. Such a shaped cutter surface has been found to provide efficient chip removal. Such a shaped cutter surface has also been found to increase stability. Such a shaped cutter surface has further been found to provide selectable cutting characteristics for different locations on a drill bit.

Figure 6:
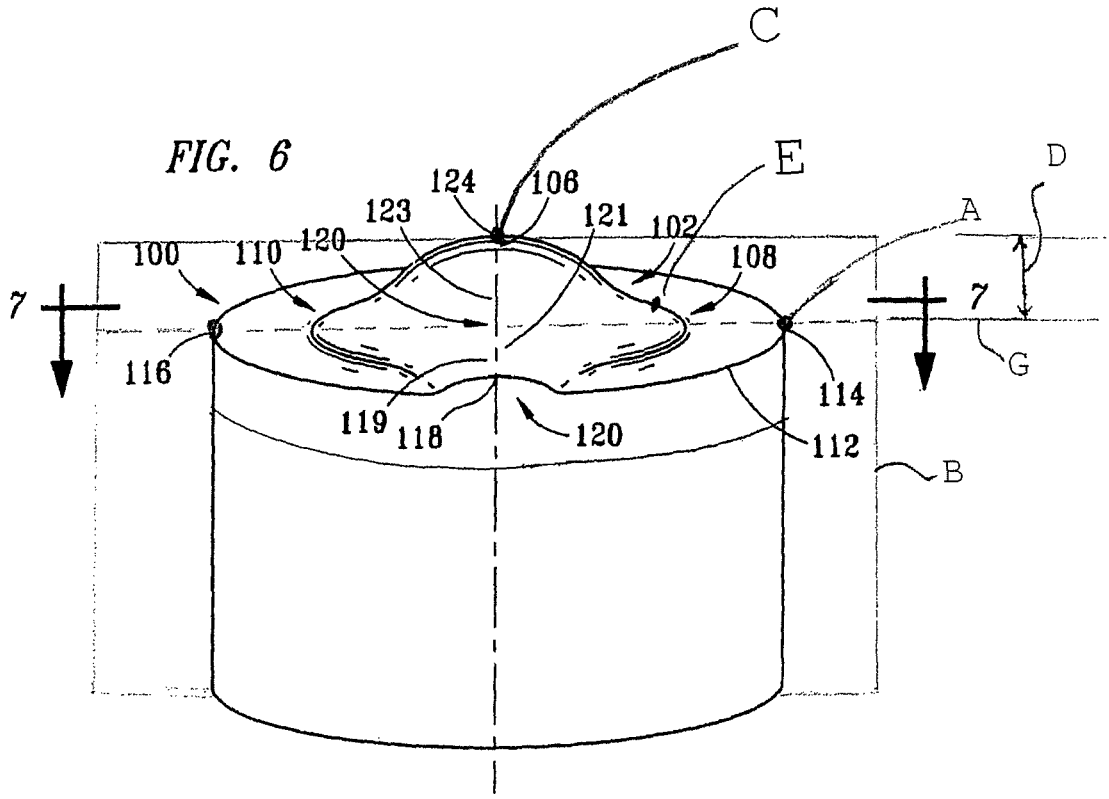
FIG. 6 is a perspective view of a cutter having an ultra hard shaped working surface, and wherein the shape of the working surface is a modified dome that is axially asymmetrical according to one embodiment of the present invention.
Figure 7:
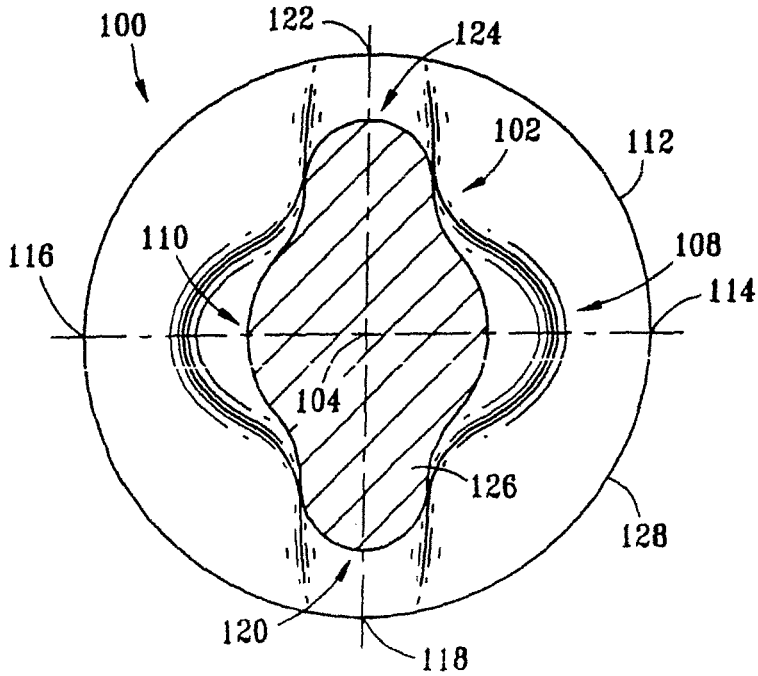
FIG. 7 is a partial cross-sectional view taken along a section line 7-7 perpendicular to the axis of the cutter of FIG. 6, halfway between the highest point and the lowest point on the working surface.

FIGS. 6 and 7 show one embodiment of a cutter 100 that has a shaped working surface 102 that is axially asymmetrical about the central axis 104. While the shaped cutter surface may be bilaterally symmetrical, it is not axially symmetrical. This unique construction allows different cutter characteristics to be achieved. The shape depicted is a modified dome shape having a convex curved portion 106 connected by concave curved portions 108 and 110 to a perimeter edge 112 at 114 and 116 respectively. The convex curved portion 106 is connected to the edge 112 at 118 with a complex curved portion 120 and is connected to the edge 112 at 122 (see FIG. 7) with another complex curved portion 124. In this embodiment the complex curved portion 120 includes a concave portion 119, a convex portion 121 and another concave portion 123. It will be understood that any one of the locations 114, 116, 118, or 122 of the perimeter edge 112 of the cutter 100 may be positioned on a drill bit so that such location of the edge is at the critical cutting region of the cutter 100.

In the exemplary embodiment shown in FIG. 6, an axial plane B extending across the convex portion 106, the concave portions 108, 110 and through a central axis of the ultra-hard material layer, intersects a first point A on the peripheral edge which is at a level D, as measured axially from a second point C on the convex portion that is at a distance from said first point no less than all levels of the concave portions along said plane, as measured axially from the second point.

The shaped working surface 102 and various concave, convex, and complex curved portions may be formed and shaped during the initial compaction of the ultra hard layer or in selected embodiments may be shaped after the ultra hard layer is formed, for example by Electro Discharge Machining (EDM) or by Electro Discharge Grinding (EDG). The ultra hard layer 140 may, for example, be formed as a polycrystalline diamond compact or a polycrystalline cubic boron nitride compact. Also, in selected embodiments, the ultra-hard layer may comprise a "thermally stable" layer. One type of thermally stable layer that may be used in embodiments of the present invention may be a TSP element or partially or fully leached polycrystalline diamond. For example, variable or programmable angle and depth EDM or EGM can be used to form variously shaped working surface contours into an otherwise uniform shaped working surface or in combination with initial compaction of various alternative surface shapes.

Figure 8A:
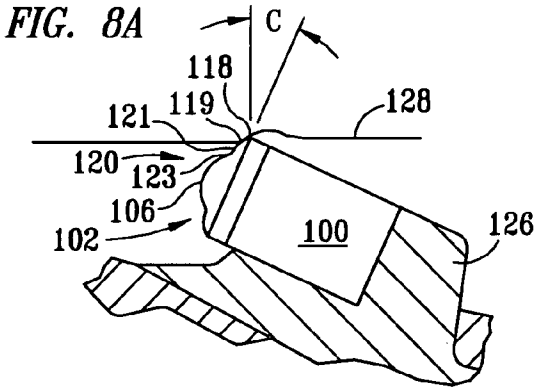
FIG. 8A is a partial cross-sectional view of a cutter mounted in a blade of a drill bit operating at a first rate of penetration in a well bore, the cutter constructed according to the cutter a FIGS. 6 and 7 and the section view taken transverse to a well bore.

In FIG. 8A, a partial section portion of a drill bit 126 is shown having a cutter 100 mounted therein. The edge 118 of cutter 100 is shown in cutting engagement with a geological formation 128. The depth of cut is shallow with only the concave curved portion 119 fully engaged in the geological formation, representing a low ROP. At this ROP, the back rake angle C is relatively small and the shaped surface 102 provides efficient cutting at a low weight on bit (WOB).

Figure 8B:
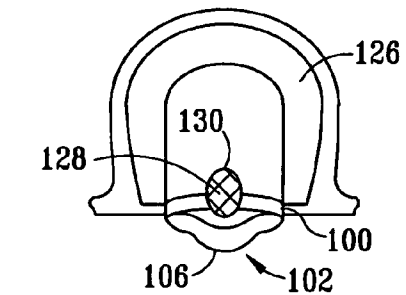
FIG. 8B is a side view of a cutter of FIG. 8A operating at the first ROP and showing the theoretical "foot print" of the cutter that engages the geological formation according to one aspect of the invention.

In FIG. 8B, the cutter 100 of FIG. 8A is shown operating at the first ROP with the shaped cutter surface 102 engaged at a first foot print 130 in the geological formation 128. The foot print 130 and the depth of cut are both small so that the force on the cutter 100 is also small.

Figure 8C:
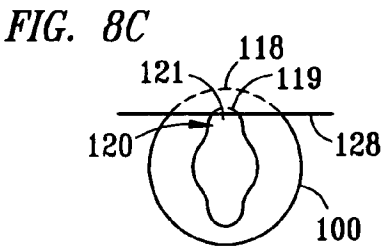
FIG. 8C is a top view of the cutter of FIGS. 8A and 8B operating at the first ROP and showing the hidden portion of the cutter that would engage the geological formation in a well bore.

FIG. 8C schematically demonstrates that the edge 118 and the curved portion 119 are engaged in the geological formation.

Figure 9A:
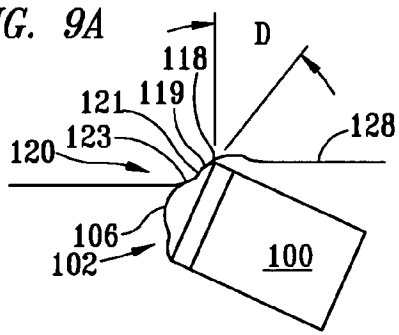
FIG. 9A is a partial cross-sectional view of a cutter of a drill bit operating at a second rate of penetration in a well bore, the cutter constructed according to the cutter of FIGS. 6 and 7 and the section view taken transverse to a well bore.

In FIG. 9A, the edge 118 of cutter 100 is shown in cutting engagement with a geological formation 128. The depth of cut is moderate with the concave curved portions 119 and the concave portion 121 fully engaged in the geological formation 128, representing a moderate ROP. At this moderate ROP, the average back rake angle D is larger than the average back rake angle C of FIG. 8A. The shaped surface 102 provides stable cutting at a moderate WOB.

Figure 9B:
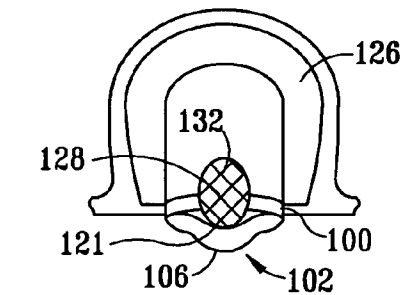
FIG. 9B is a side view of a cutter of FIG. 9A operating at the second ROP and showing the theoretical "foot print" of the cutter that engages the geological formation according to one aspect of the invention.

In FIG. 9B, the cutter 100 of FIG. 9A is shown operating at the moderate ROP with the shaped cutter surface 102 engaged at a moderate size foot print 132 in the geological formation 128. The foot print 132 is moderately sized so that the force on the cutter 100 that is generated by the footprint area and the normal force due to the average back rake angle are also moderate. It will also be noted that the convex curved surface portion 121 of the rounded shaped surface 102 "plows" through the formation and causes the cuttings or the chips from the formation to move sideways away from the surface 102. This reduces shear forces (the equal side forces counteract each other) and reduces balling or buildup of chips on the cutter surface 102 and also facilitates heat dissipation. When the shear forces are reduced with a shaped working surface, lower torque can be applied to the bit so that unstable situations are also reduced.

Figure 9C:
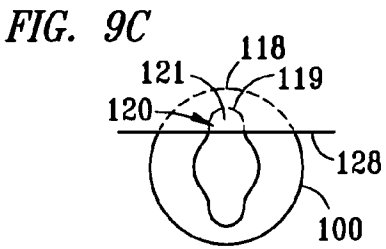
FIG. 9C is a top view of the cutter of FIGS. 9A and 9B operating at the second ROP and showing the hidden portion of the cutter that would engage the geological formation in a well bore.

FIG. 9C schematically demonstrates that the edge 118, the concave curved portion 119, and the convex curved portion 121 are engaged in the geological formation 128.

Figure 10A:
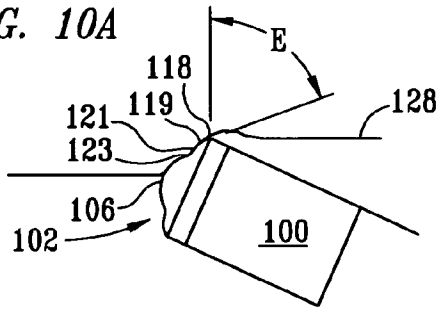
FIG. 10A is a partial cross-sectional view of a cutter operating at a third rate of penetration in a well bore, the cutter constructed according to the cutter of FIGS. 6 and 7 and the section view taken transverse to a well bore.

In FIG. 10A, the edge 118 of cutter 100 is shown in cutting engagement with a geological formation 128. The depth of cut is deep or aggressive with the first concave curved portions 119, the convex portion 121, and the second convex portion fully engaged in the geological formation 128, representing a large ROP. At this large ROP, the average back rake angle E is larger than the average back rake angles C of FIGS. 8A and D of FIG. 9A.

Figure 10B:
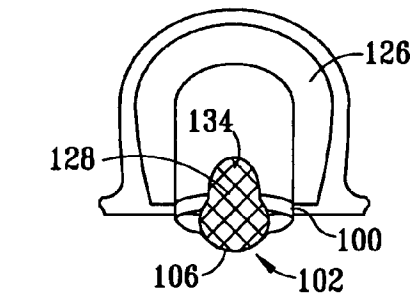
FIG. 10B is a side view of a cutter of FIG. 10A operating at the third ROP and showing the theoretical "foot print" of the cutter that engages the geological formation according to one aspect of the invention.

In FIG. 10B, the cutter 100 of FIG. 10A is shown operating at the large ROP with the shaped cutter surface 102 engaged at a large size foot print 134 in the geological formation 128. The foot print 134 is large sized so that the force on the cutter 100 that is generated by the footprint area, and the normal force due to the average back rake angle E is also large. It will be understood that the steepness of the convex portion progressively increases with the depth of cut until the concave portion 106 becomes engaged. Thus, the area of engagement 134 also increases with the depth of the cut. As the depth increases, the back rake angle increases and the increased back rake angle effectively acts to slow or to stop, the increase in ROP. This usefully provides a built-in control against too deep of a cut and facilitates increased stability of the drill bit on which the shaped cutters are mounted. The shaped surface 102 therefore provides stabilization against unexpected or sudden increases in ROP.

Figure 10C:
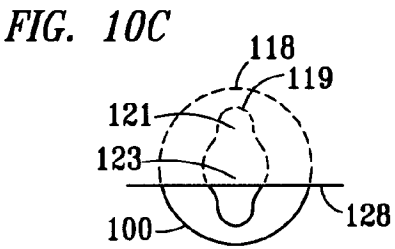
FIG. 10C is a top view of the cutter of FIGS. 10A and 10B operating at the third ROP and showing the hidden portion of the cutter that would engage the geological formation in a well bore.

FIG. 10C schematically demonstrates that the edge 118, the concave curved portion 119, the convex curved portion 121, and the concave curved portion 123 are engaged in the geological formation 128.

FIG. 11 shows a front view of a cutter 140 having a cutter shaped surface 142 according to another embodiment of the invention. The cutter surface 142 is axially asymmetrical. Inward from circumferential edge 144 of the shaped cutter surface 142 there are two relative peaks 146 and 148.

FIG. 12 shows a side view of the alternative embodiment of cutter 140 of FIG. 11. The relative peaks 146 and 148 are each formed with generally convex curved surfaces. A convex surface 145 connects between peak 146 and the edge 144. A generally concave curved surface 147 connects between the relative peak 146 and the relative peak 148. The curved surface of relative peak 148 generally continues as a convex curve and connects to the rear edge 149. The convex curved surface effectively provides the cutter with a section angle 141 that is greater than 90 degrees. Compared to a flat top cutter, a cutter having a shaped working surface that provides a section angle greater than 90 degrees will produce reduced spalling and reduced chipping. When the cutting edge has a convex curved surface as at edges 144 or 149, the section angle is greater than 90 degrees and the strength against chipping and spalling is improved relative to a flat top cutter. The convex curved shaped surface can also guide the chips to reduce balling.

FIG. 13 shows a rear view of the cutter 140 having the shaped cutter surface 142 of FIGS. 11 and 12. The relative peak 148 is generally convex and connects with a concave surface portion 150 to one side edge 151 and connects with another concave curved surface 152 to another side edge 153. When the cutting edge has a concave curved surface as at side edges 151 and 152, the cutter has a section angle 143 that is less than 90 degrees and provides improved penetration and more effective shearing. For example this can help to penetrate firm and non-abrasive geological formations. It will be understood from the disclosure that combinations of convex and concave shaped surfaces can be made according to aspects of the invention to produce a combination of desired characteristics at different cutting edges and at different cutting depths.

FIG. 14 shows a partial top cross-sectional view taken along section line 14-14 of FIG. 11. The section is along a horizontal plane "halfway" between the lowest point 154 and the highest point 155 of the cutter 140 having the shaped cutter surface 142 of FIGS. 11, 12, and 13. Note that "halfway as used herein refers to the mid point between the projection point of the high point and the low point on the axis of the cutter. In this embodiment the lowest point 154 corresponds to the front edge 144 and the highest point 155 corresponds to the relative peak 148. A "halfway" perimeter 156 of the cross-section circumscribes the "halfway" area 157. In one embodiment, the length of the "halfway" perimeter 156 is greater than about 20% of the length of the total perimeter 158 of the cutter 140. In another embodiment, the "halfway" area 157 is greater than about 20% of the total horizontal cross-sectional area 159 of the cutter 140.

In another embodiment, the length of the "halfway" perimeter 156 is greater than about 50% of the length of the total perimeter 158 of the cutter 140. The longer perimeter is useful to provide good strength and to provide a shaped working surface with the intended cutting characteristics. In yet another embodiment, the "halfway" area 157 is greater than about 50% of the total horizontal cross-sectional area 159 of the cutter 140. The greater area is useful to provide good strength and to provide a shaped working surface with the intended cutting characteristics.

FIG. 15 shows a front view of a cutter 160 having a cutter shaped surface 162 according to another embodiment of the invention. The cutter surface 162 is axially asymmetrical. Inward from circumferential edge 164 of the shaped cutter surface 162 there are two relative peaks 166 and 168. In this embodiment, the relative peak 166 is a smooth convex curved shape and the relative peak 168 is a flat surface.

FIG. 16 shows a side view of the alternative embodiment of cutter 160 of FIG. 15. The relative peak 166 is formed with generally convex curved surfaces and relative peak 168 is formed with curved surrounding surfaces leading to a flat surface. A convex surface 165 connects between peak 166 and the edge 164. A generally concave curved surface 167 connects between the relative peak 166 and the relative peak 168. The flat surface of relative peak 168 generally continues as a flat surface and connects to the rear edge 169.

FIG. 17 shows a rear view of the cutter 160 having the shaped cutter surface 162 of FIGS. 15 and 16. The relative peak 168 is flat and connects with a convex surface portion 170 to one side edge 171 and connects with another concave curved surface 172 to another side edge 173.

FIG. 18 shows a partial top cross-sectional view taken along section line 18-18 of FIG. 15. The section is along a horizontal plane halfway between the lowest point 174 and the highest point 175 of the cutter 160 having the shaped cutter surface 162 of FIGS. 15, 16, and 17. In this embodiment, the lowest point 174 corresponds to the front edge 164 and the highest point 175 corresponds to the relative peak 168. A "halfway" perimeter 176 of the cross-section circumscribes the "halfway" area 177. The length of the "halfway" perimeter 176 is greater than about 20% of the length of the total perimeter 178 of the cutter 160. The "halfway" area 177 is greater than about 20% of the total horizontal cross-sectional area 179 of the cutter 160.

In another embodiment, the length of the "halfway" perimeter 176 is greater than about 50% of the length of the total perimeter 178 of the cutter 160. The longer perimeter is useful to provide good strength and to provide a shaped working surface with the intended cutting characteristics. In yet another embodiment, the "halfway" area 177 is greater than about 50% of the total horizontal cross-sectional area 179 of the cutter 160. The greater area is useful to provide good strength and to provide a shaped working surface with the intended cutting characteristics.

Figure 19A:
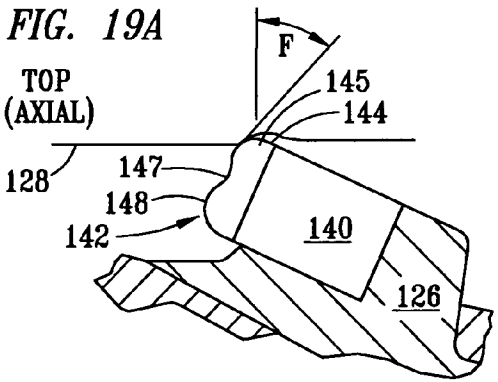
FIG. 19A is a partial cross-sectional view of a cutter mounted in a blade of a drill bit operating at a first rate of penetration in a well bore, the cutter constructed according to the cutter of FIGS. 11-14 and the section view taken transverse to a well bore.

In FIG. 19A, a partial section portion of a drill bit 126 is shown having the cutter 140 according to the embodiment of FIGS. 11-14 mounted therein. The edge 144 of cutter 140 is shown in cutting engagement with a geological formation 128. The depth of cut is relatively small with only the convex curved portion 145 fully engaged in the geological formation, representing a low ROP. At this ROP, the average back rake angle F is moderate and the shaped surface 142 provides controlled cutting at a moderate WOB. The convex surface portion 145 provides significant strength to the cutting edge similar to a chamfer or an axially symmetrical round top cutter surface of FIG. 14.

Figure 19B:
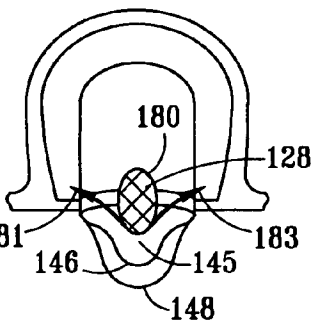
FIG. 19B is a side view of a cutter of FIG. 19A operating at the first ROP and showing the theoretical "foot print" of the cutter that engages the geological formation according to one aspect of the invention.

In FIG. 19B, the cutter 140 of FIG. 19A is shown operating at the relatively small ROP with the shaped cutter surface 142 engaged at a first foot print 180 in the geological formation 128. The foot print 180 is relatively small so that the force on the cutter 140 is also small. Also, chips schematically represented by arrows 181 and 183, are deflected to either side of the relative peak 146.

Figure 19C:
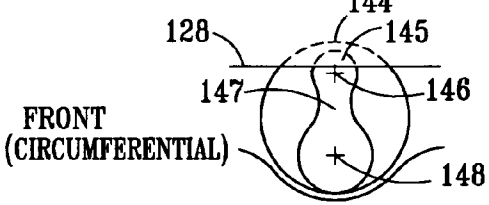
FIG. 19C is a top view of the cutter of FIGS. 19A and 19B operating at the first ROP and showing the hidden portion of the cutter that would engage the geological formation in a well bore.

FIG. 19C schematically demonstrates that the edge 144 and the convex curved portion 145 are engaged in the geological formation.

Figure 20A:
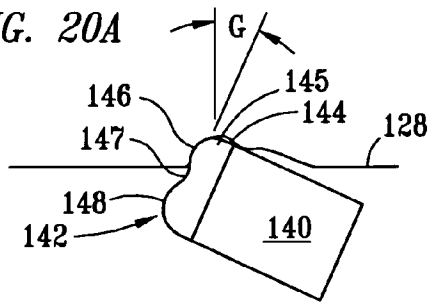
FIG. 20A is a partial cross-sectional view of a cutter mounted in a blade of a drill bit operating at a second rate of penetration in a well bore, the cutter constructed according to the cutter of FIGS. 15-18 and the section view taken transverse to a well bore.

In FIG. 20A, the edge 144 of cutter 140 is shown in cutting engagement with a geological formation 128. The depth of cut is moderate with the convex curved portions 145 and a portion of the concave curved surface 147 fully engaged in the geological formation 128. This represents a moderate ROP. At this moderate ROP, the average back rake angle G is relatively small (less than or about the same as the average back rake angle F of FIG. 19A.) This results from the unique shape of the shaped cutter surface 142, wherein the initial portion of the concave curve 147 between the relative peaks 146 and 148 is at essentially a very small back rake angle so that its contribution to the average back rake angle decreases the average back rake angle. Thus, according to this embodiment, without a significant increase in the WOB, the ROP can be increased to a relatively moderate ROP. The convex surface 145 at edge 144 still provides good strength. The shaped surface 142 provides good cutting at a moderately aggressive ROP without significant increase in the WOB because the average back rake angle is smaller than it is for a relatively small ROP.

Figure 20B:
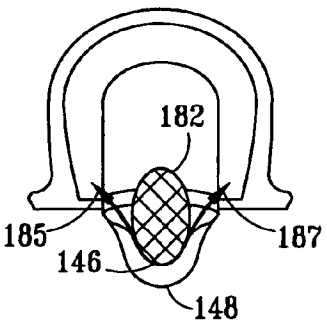
FIG. 20B is a side view of a cutter of FIG. 20A operating at the second ROP and showing the theoretical "foot print" of the cutter that engages the geological formation according to one aspect of the invention.

In FIG. 20B, the cutter 140 of FIG. 20A is shown operating at the moderate ROP with the shaped cutter surface 142 engaged at a moderate size foot print 182 in the geological formation 128. The foot print 182 is moderately sized so that the force on the cutter 140 that is generated by the footprint area and the normal force due to the average back rake angle are in a range of relatively small to relatively moderate. Good cutting is provided in a range of small to moderate ROP and changes in the ROP within this range do not dramatically change the cutting characteristics of the drill bit on which the shaped cutters 140 are mounted, according to this embodiment of the invention. The shaped surface 142 therefore provides good cutting even with unexpected or sudden changes in ROP.

It will also be noted that the rounded shaped surface 142, including the ridge formed by peaks 146 and 148 connected with curved surface 147, effectively "plows" through the formation and causes the cuttings or the chips from the formation to move sideways, as indicated by arrows 185 and 187, away from the shaped surface 142. This reduces shear forces (the equal side forces tend to counteract each other). The shape of the cutter according to this embodiment, and depending upon the position of the cutter on the drill bit, provides a balance of forces on the cutter working surface. Balling or buildup of chips on the cutter surface 142 is also reduced. The flow of chips and the reduced build-up also facilitates heat dissipation.

According to another aspect of the invention, the shaped surface of the cutter can be designed or selected to facilitate force balancing, work balancing and/or wear balancing of a drill bit on which a plurality of cutters are mounted. Force balancing and work balancing of a drill bit refers to a substantial balancing of forces and work between cutting elements, rows of cutting elements, rows of cutting elements located in corresponding positions on a blade of a drill bit, cutting elements located in corresponding positions on different blades, or a plurality of cutters mounted on a drill bit. Balancing may also be performed over the entire drill bit (e.g., over the entire cutting structure or over all blades), over the life of the drill bit, or at different cutting depths. As the depth of cut, the ROP, or the WOB changes, the force balance and/or work balance may be affected by variations in the working surface shape of the cutter. As the bit wears, the force balance and/or work balance may also be affected by changes in the working surface shape of the cutter or changes in the drill bit geometry. This may be referred to as wear balance. The invention permits bit designers and cutter designers to observe how the force, work, and/or wear balances of the bit are affected by cutter shape changes and bit geometry changes resulting from wear. The resulting observations can be used to make modification to the initial cutter geometry and the positioning of cutters with varied or selected shaped cutter surfaces to change and/or to optimize the force balance, the work balance and/or wear balance of the bit throughout the life of the bit.

Figure 20C:
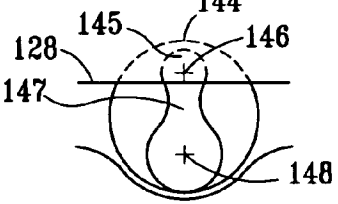
FIG. 20C is a top view of the cutter of FIGS. 20A and 20B operating at the second ROP and showing the hidden portion of the cutter that would engage the geological formation in a well bore.

FIG. 20C schematically demonstrates that the edge 144, the convex curved portion 145, and the convex curved relative peak 146 are engaged in the geological formation 128.

Figure 21A:
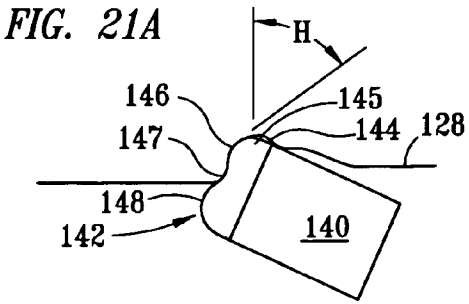
FIG. 21A is a partial cross-sectional view of a cutter mounted in a blade of a drill bit operating at a third rate of penetration in a well bore, the cutter constructed according to the cutter of FIGS. 15-18 and the section view taken transverse to a well bore.

In FIG. 21A, the edge 144 of cutter 140 is shown in cutting engagement with a geological formation 128. The depth of cut is relatively large or aggressive with the first convex curved portion 145, the convex relative peak 146, a major portion of second concave curve 147 fully engaged in the geological formation 128, representing a large ROP. At this large ROP, the average back rake angle H is relatively larger than the average back rake angles G of FIGS. 20A and F of FIG. 19A.

Figure 21B:
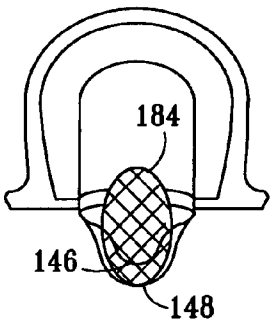
FIG. 21B is a side view of a cutter of FIG. 21A operating at the third ROP and showing the theoretical "foot print" of the cutter that engages the geological formation according to one aspect of the invention.

In FIG. 21B, the cutter 140 of FIG. 21A is shown operating at the large ROP with the shaped cutter surface 142 engaged at a large size foot print 184 in the geological formation 128. The foot print 184 has a relatively large area so that the force on the cutter 140 that is generated by the footprint area and the normal force due to the average back rake angle H are also relatively large. It will be understood that the steepness of the convex curve portions 145 and 146 progressively decreases with the depth of cut until the concave curve portion 147 leading up to the second relative peak 148 becomes engaged in the geological formation. The area of engagement 148 increases with the depth of the cut. As the depth initially increases, the back rake angle first decreases and tends to reduce the rate of increase of total force on the cutter as would be expected from the increase in footprint area 148. Thus, a small to moderate WOB is maintained. Subsequently, as the ROP increases beyond a moderate amount, the average back rake angle increases significantly. This usefully facilitates slowing or stopping the increase in the ROP. This tends to stabilize a drill bit on which such cutters are mounted according to this embodiment of the invention.

Figure 21C:
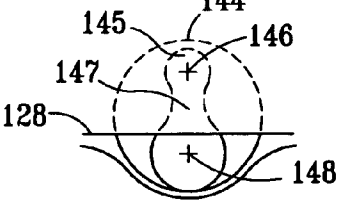
FIG. 21C is a top view of the cutter of FIGS. 21A and 21B operating at the third ROP and showing the hidden portion of the cutter that would engage the geological formation in a well bore.

FIG. 21C schematically demonstrates that the edge 144, the convex curved portion 145, the convex relative peak 146, and the concave curved portion 147 leading down from relative peak 146 and partially up toward the relative peak 148 are engaged in the geological formation 128.

Figures 22, 23, 24, 25, 26, 27, 28, 29:
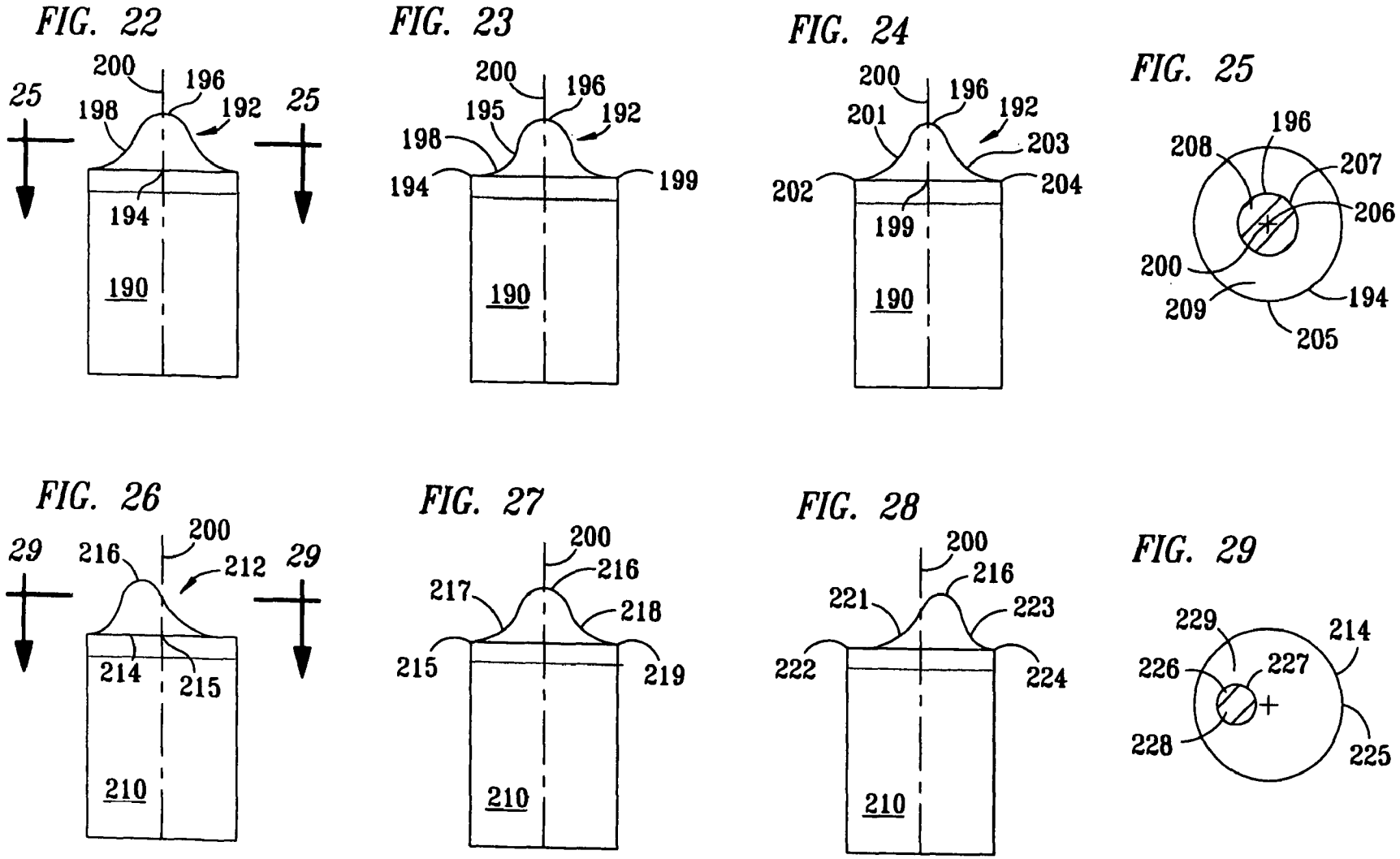
FIG. 22 is a front view of a cutter having an ultra hard shaped working surface, wherein the shape of the working surface has a rounded relative peak defined by a first concave curve connected to a convex curve connected to a second concave curve according to another alternative embodiment of the present invention.
FIG. 23 is a side view of the cutter of FIG. 22.
FIG. 24 is a back view of the cutter of FIG. 22.
FIG. 25 is a top partial section view of the cutter of FIG. 22 taken along a section line 25-25 laterally through the shaped surface halfway between the highest point and the lowest point on the surface.
FIG. 26 is a front view of a cutter having an ultra hard shaped working surface, wherein the shape of the working surface has an axial asymmetrical relative peak defined by a first concave curve connected to a convex curve connected to a second concave curve according to another alternative embodiment of the present invention.
FIG. 27 is a side view of the cutter of FIG. 26.
FIG. 28 is a back view of the cutter of FIG. 26.
FIG. 29 is a top partial section view of the cutter of FIG. 26 taken along a section line 29-29 laterally through the shaped surface halfway between the highest point and the lowest point on the surface.

FIG. 22 shows a front view of a cutter 190 having a cutter shaped surface 192 according to another embodiment of the invention. The cutter surface 192 is axially symmetrical. Inward from circumferential edge 194 of the shaped cutter surface 192, there is one relative peak 196. The peak 196 has a convex curved shape and is connected to the circumferential edge 194 with concave surface 198 revolved around an axis 200.

FIG. 23 shows a side view of the alternative embodiment of cutter 190 of FIG. 22. The peak 146 is a convex curved surface. A first concave surface portion 195 connects between peak 146 and the front edge 194. The curved surface of the peak 196 generally connects through another concave surface portion 197 to the rear edge 199.

FIG. 24 shows a rear view of the cutter 190 having the shaped cutter surface 192 of FIGS. 22 and 23. The relative peak 196 is convex and connects with a concave surface portion 201 to one side edge 202 and connects with another concave curved surface portion 203 to another side edge 204.

FIG. 25 shows a partial top cross-sectional view taken along section line 25-25 of FIG. 22. The section is along a horizontal plane halfway between the lowest point 205 and the highest point 206 of the shaped cutter surface 192 of FIGS. 22, 23, and 24. In this embodiment, the lowest point 205 corresponds to the front edge 194 and the highest point 206 corresponds to the peak 196. A "halfway" perimeter 207 of the cross-section circumscribes the "halfway" area 208. The length of the "halfway" perimeter 207 is greater than about 20% of the length of the total perimeter edge 194 of the cutter 190. The "halfway" area 208 is greater than about 20% of the total horizontal cross-sectional area 209 of the cutter 190.

In another embodiment, the length of the "halfway" perimeter 207 is greater than about 50% of the length of the total perimeter 194 of the cutter 190. The longer perimeter is useful to provide good strength and to provide a shaped working surface with the intended cutting characteristics. In yet another embodiment, the "halfway" area 208 is greater than about 50% of the total horizontal cross-sectional area 209 of the cutter 190. The greater area is useful to provide good strength and to provide a shaped working surface with the intended cutting characteristics.

FIG. 26 shows a front view of a cutter 210 having a cutter shaped surface 212 according to another embodiment of the invention. The cutter surface 212 is asymmetrical with respect to the axis 220 of the cutter 210. Inward from circumferential edge 214 of the shaped cutter surface 212 there is one relative peak 216. The relative peak 216 has a convex curved shape and is connected to the circumferential edge 214 with concave curved surfaces.

FIG. 27 shows a side view of the alternative embodiment of cutter 210 of FIG. 26. The peak 216 has a convex curved shape. A first concave surface portion 217 connects between peak 216 and the front 215 of circumferential edge 214. The curved surface of the peak 216 connects through another concave surface portion 218 to a rear edge portion 219.

FIG. 28 shows a rear view of the cutter 210 having the shaped cutter surface 212 of FIGS. 26 and 27. The relative peak 216 is convex and connects with a concave surface portion 221 to one side edge 222 and connects with another concave curved surface portion 223 to another side edge portion 224.

FIG. 29 shows a partial top cross-sectional view taken along section line 29-29 of FIG. 26. The section view is along a horizontal plane halfway between the lowest point 225 and the highest point 226 of the shaped cutter surface 212 of FIGS. 26, 27, and 28. In this embodiment, the lowest point 225 corresponds to the side edge 222 and the highest point 226 corresponds to the peak 216. A "halfway" perimeter 227 of the cross-section circumscribes the "halfway" area 228. The length of the "halfway" perimeter 227 is greater than about 20% of the length of the total perimeter edge 214 of the cutter 210. The "halfway" area 228 is greater than about 20% of the total horizontal cross-sectional area 229 of the cutter 210.

In another embodiment, the length of the "halfway" perimeter 227 is greater than about 50% of the length of the total perimeter 214 of the cutter 210. The longer perimeter is useful to provide good strength and to provide a shaped working surface with the intended cutting characteristics. In yet another embodiment, the "halfway" area 227 is greater than about 50% of the total horizontal cross-sectional area 229 of the cutter 210. The greater area is useful to provide good strength and to provide a shaped working surface with the intended cutting characteristics.

Figure 30:
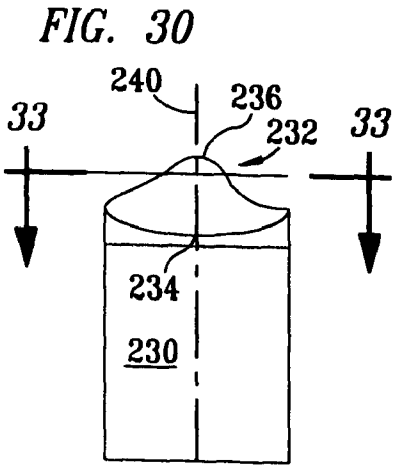
FIG. 30 is a front view of a cutter having an ultra hard shaped working surface, wherein the shape of the working surface having an axial asymmetrical relative peak defined by a first concave curve connected to a convex curve connected to a second concave curve according to another alternative embodiment of the present invention.

FIG. 30 shows a front view of a cutter 230 having a cutter shaped surface 232 according to another embodiment of the invention. The cutter surface 232 is asymmetrical with respect to the axis 240 of the cutter 230. Inward from circumferential edge 234 of the shaped cutter surface 232, there is one relative peak 236. The relative peak 236 has a convex curved shape.

Figure 31:
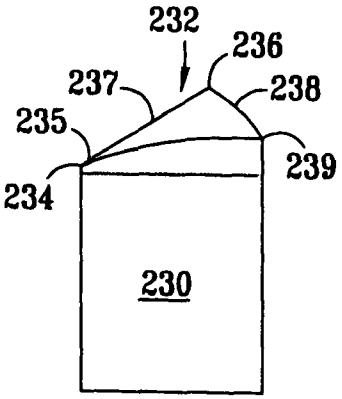
FIG. 31 is a side view of the cutter of FIG. 30.

FIG. 31 shows a side view of the alternative embodiment of cutter 230 of FIG. 30. The peak 236 has a convex curved shape. An angled straight surface portion 237 connects between peak 236 and the front 235 of circumferential edge 234. The convex curved surface of the peak 236 connects through a concave surface portion 238 to a rear edge portion 239.

Figure 32:
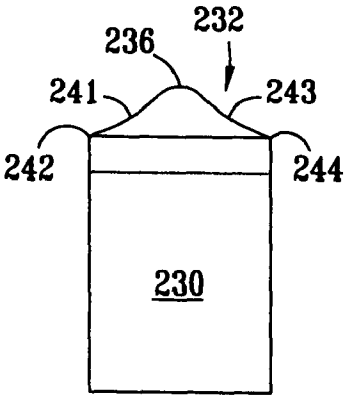
FIG. 32 is a back view of the cutter of FIG. 30.

FIG. 32 shows a rear view of the cutter 230 having the shaped cutter surface 232 of FIGS. 30 and 31. The relative peak 236 is convex and connects with a concave surface portion 241 to one side edge 242 and connects with another concave curved surface portion 243 to another side edge portion 244.

Figure 33:
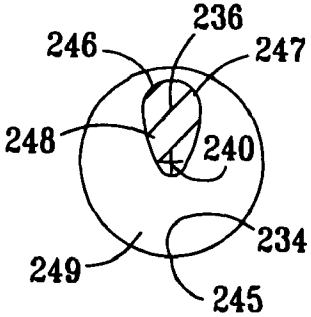
FIG. 33 is a top partial section view of the cutter of FIG. 30 taken along a section line 33-33 laterally through the shaped surface halfway between the highest point and the lowest point on the surface.

FIG. 33 shows a partial top cross-sectional view taken along section line 33-33 of FIG. 30. The section view taken along a horizontal plane halfway between the lowest point 245 and the highest point 246 of the shaped cutter surface 232 of FIGS. 30, 31, and 32. In this embodiment, the lowest point 245 corresponds to the front edge portion 234 and the highest point 246 corresponds to the peak 236. A "halfway" perimeter 247 of the cross-section circumscribes the "halfway" area 248. The length of the "halfway" perimeter 247 is greater than about 20% of the length of the total perimeter edge 234 of the cutter 230. The "halfway" area 248 is greater than about 20% of the total horizontal cross-sectional area 249 of the cutter 230.

In another embodiment, the length of the "halfway" perimeter 247 is greater than about 50% of the length of the total perimeter 234 of the cutter 230. The longer perimeter is useful to provide good strength and to provide a shaped working surface with the intended cutting characteristics. In yet another embodiment, the "halfway" area 248 is greater than about 50% of the total horizontal cross-sectional area 249 of the cutter 230. The greater area is useful to provide good strength and to provide a shaped working surface with the intended cutting characteristics.

Figure 34:
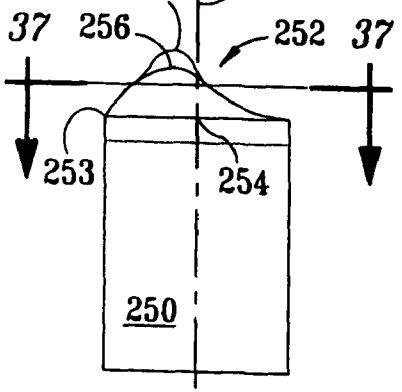
FIG. 34 is a front view of a cutter having an ultra hard shaped working surface, wherein the shape of the working surface has a plurality of axial asymmetrical relative peaks defined by a first concave curve connected to a convex curve connected to a second concave curve connected to a second convex curve according to another alternative embodiment of the present invention.

FIG. 34 shows a front view of a cutter 250 having a cutter shaped surface 252 according to another embodiment of the invention. The cutter surface 252 is axially asymmetrical. Inward from circumferential edge 254 of the shaped cutter surface 252, there are two relative peaks 256 and 258. In this embodiment, the relative peaks 256 and 258 are off-set toward one side edge 263 from the central axis 260 and from the front edge 254.

Figure 35:
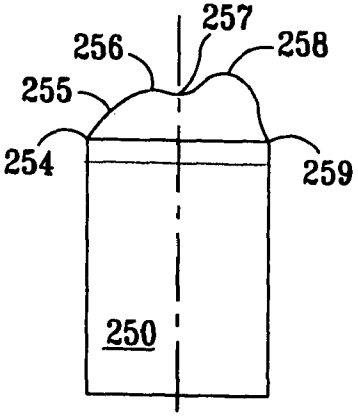
FIG. 35 is a side view of the cutter of FIG. 34.

FIG. 35 shows a side view of the alternative embodiment of cutter 250 of FIG. 34. The relative peaks 256 and 258 are each formed with generally convex curved surfaces. A convex surface 255 connects between peak 256 and the front edge portion 254. A generally concave curved surface 257 connects between the relative peak 256 and the relative peak 258. The curved surface of relative peak 258 generally continues and connects to the rear edge 259.

Figure 36:
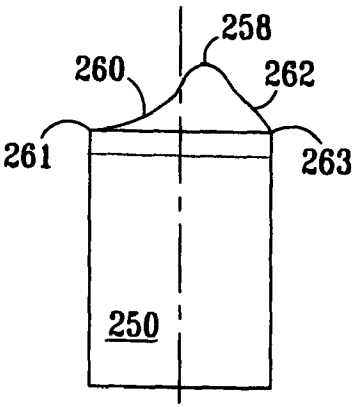
FIG. 36 is a back view of the cutter of FIG. 34.

FIG. 36 shows a rear view of the cutter 250 having the shaped cutter surface 252 of FIGS. 34 and 35. The relative peak 258 is generally convex and connects with a concave surface portion 260 to one side edge 261 and connects with another convex curved surface 262 to the other side edge 263.

Figure 37:
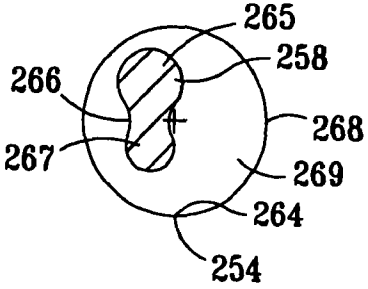
FIG. 37 is a top partial section view of the cutter of FIG. 34 taken along a section line 37-37 laterally through the shaped surface halfway between the highest point and the lowest point on the surface.

FIG. 37 shows a partial top cross-sectional view taken along section line 37-37 of FIG. 34. The section is along a horizontal plane halfway between the lowest point 264 and the highest point 265 of the cutter 250 having the shaped cutter surface 252 of FIGS. 34, 35, and 36. In this embodiment, the lowest point 264 corresponds to the front edge 254 and the highest point 265 corresponds to the relative peak 258. A "halfway" perimeter 266 of the cross-section circumscribes the "halfway" area 267. The length of the "halfway" perimeter 266 is greater than about 20% of the length of the total perimeter 268 of the cutter 250. The "halfway" area 267 is greater than about 20% of the total horizontal cross-sectional area 269 of the cutter 250.

In another embodiment, the length of the "halfway" perimeter 266 is greater than about 50% of the length of the total perimeter 268 of the cutter 250. The longer perimeter is useful to provide good strength and to provide a shaped working surface with the intended cutting characteristics. In yet another embodiment, the "halfway" area 267 is greater than about 50% of the total horizontal cross-sectional area 269 of the cutter 250. The greater area is useful to provide good strength and to provide a shaped working surface with the intended cutting characteristics.

Figure 1:
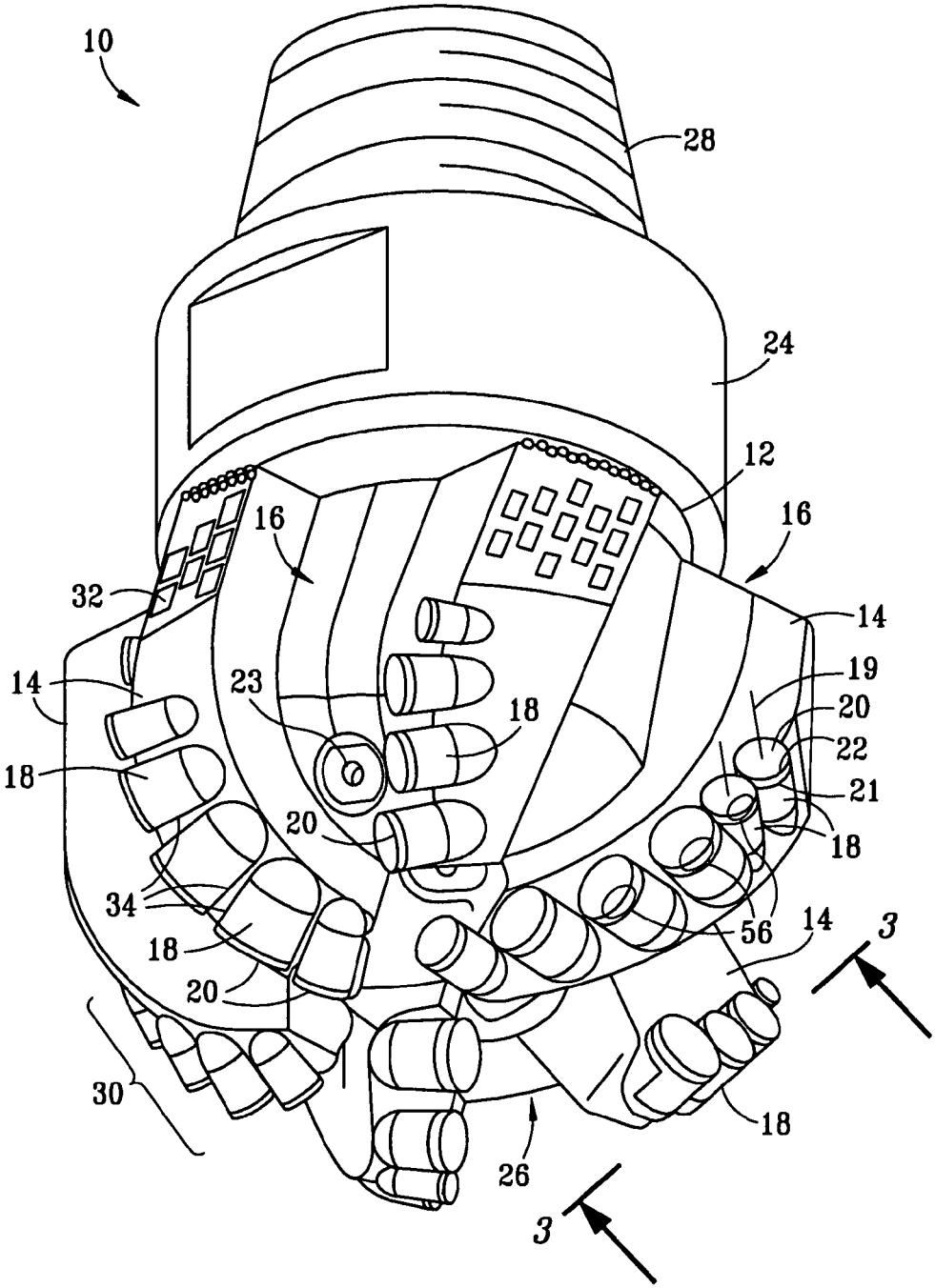
FIG. 1 (PRIOR ART)
FIG. 1 is a perspective view of a prior art fixed cutter drill bit sometimes referred to as a "drag bit"
Figure 2:
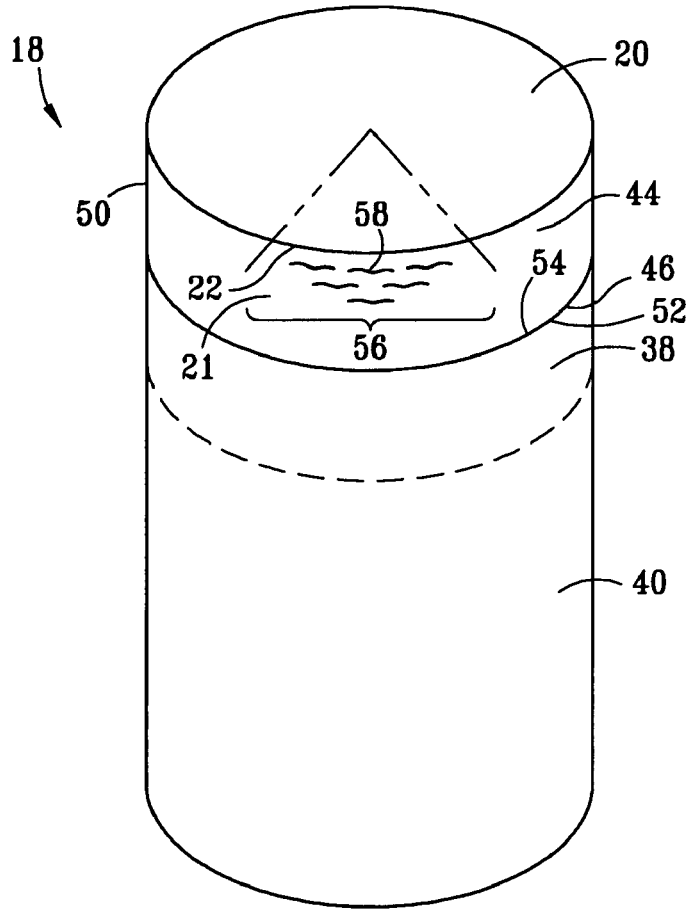
FIG. 2 (PRIOR ART)
FIG. 2 is a perspective view of a prior art cutter or cutter insert with an ultra hard layer bonded to a substrate or stud.
Figure 3:
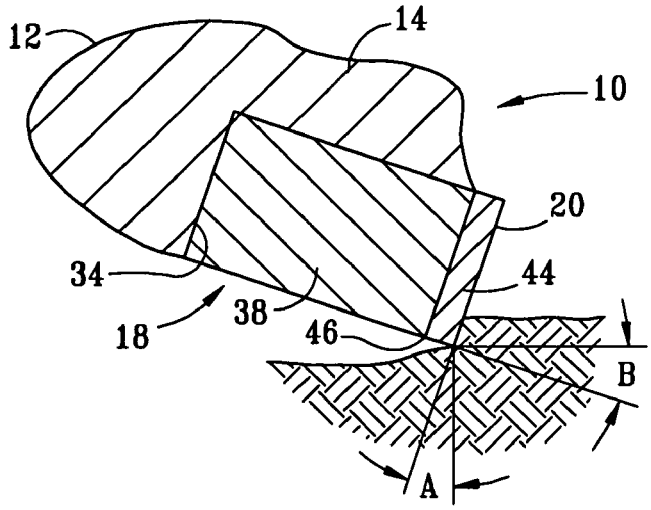
FIG. 3 (PRIOR ART)
FIG. 3 is a partial section view of a prior art flat top cutter held in a blade of a drill bit engaged with a geological formation (shown in partial section) in a cutting operation.
Figure 4:
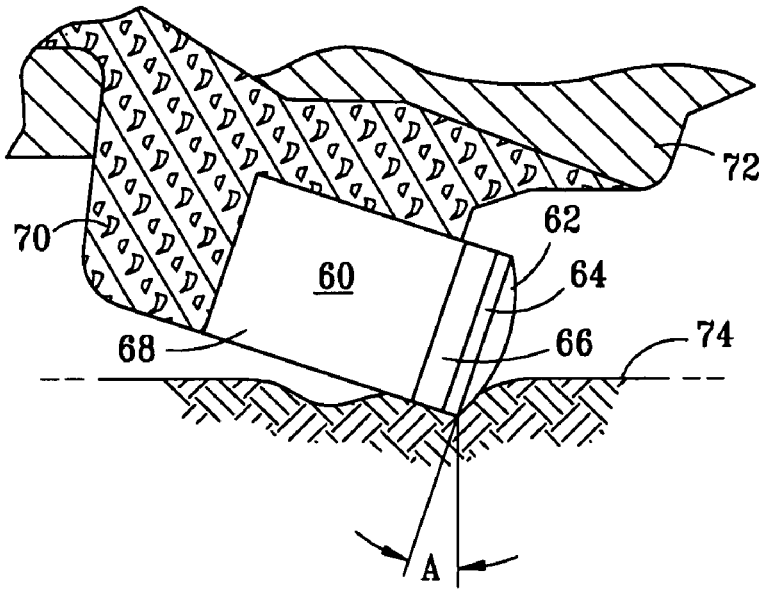
FIG. 4 (PRIOR ART)
FIG. 4 is a schematic view of a prior art dome top cutter with an ultra hard layer bonded to a substrate that is bonded to a stud, where the cutter is held in a blade of a drill bit (shown in partial section) and engaged with a geological formation (also shown in partial section) in a cutting operation.
Figure 5:
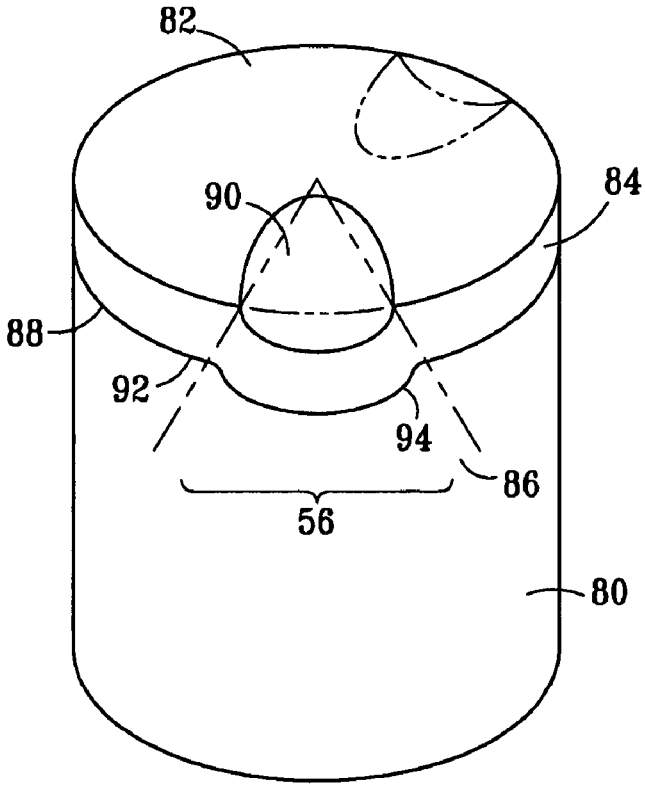
FIG. 5 (PRIOR ART)
FIG. 5 is a perspective view of a prior art scoop top cutter with an ultra hard layer bonded to a substrate at a non-planar interface (NPI)
Figure 38A:
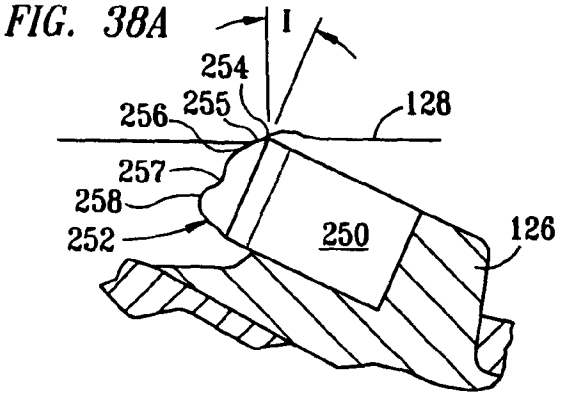
FIG. 38A is a partial cross-sectional view of a cutter mounted in a blade of a drill bit operating at a first rate of penetration in a well bore, the cutter constructed according to the cutter a FIGS. 34-37 and the section view taken transverse to a well bore.

In FIG. 38A, a partial section portion of a drill bit 126 is shown having the cutter 250 according to the embodiment of FIGS. 34-37 mounted therein. The edge 254 of cutter 250 is shown in cutting engagement with a geological formation 128. The depth of cut is shallow with only the convex curved portion 255 fully engaged in the geological formation 128, representing a low ROP. At this ROP, the average back rake angle I is moderate and the shaped surface 252 provides controlled cutting at a moderate WOB. The convex surface 255 provides good strength to the cutting edge similar to a chamfer or an axially symmetrical round top cutter surface of FIG. 4.

Figure 38B:
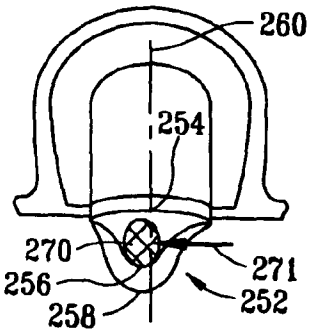
FIG. 38B is a side view of a cutter of FIG. 38A operating at the first ROP and showing the theoretical "foot print" of the cutter that engages the geological formation according to one aspect of the invention.

In FIG. 38B, the cutter 250 of FIG. 38A is shown operating at the first ROP with the shaped cutter surface 252 engaged at a first foot print 270 in the geological formation 128. The foot print 270 is relatively small so that the force on the cutter 250 is also relatively small. To obtain useful side loading characteristics, the relative peak 256 and the connecting convex surface 255 are off-set from the critical point of cutting contact. Thus, the foot print 270 is also offset from the center of the cutter 250 and also from the center of the edge 254 at the critical cutting region. This provides a small side loading 271 on the cutter 250. In this instance the force on the shaped surface 252 of the individual cutter 250 is not balanced to zero. Rather a small net side loading 271 results.

Figure 38C:
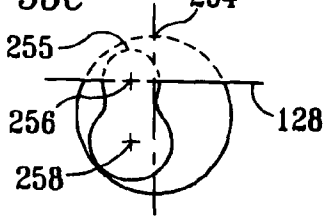
FIG. 38C is a top view of the cutter of FIGS. 38A and 38B operating at the first ROP and showing the hidden portion of the cutter that would engage the geological formation in a well bore.

FIG. 38C schematically demonstrates that the edge 254 and the curved portion 255 are engaged in the geological formation 128.

Figure 39A:
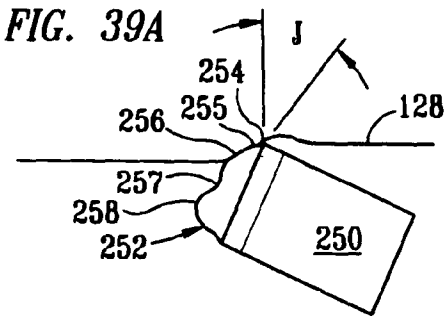
FIG. 39A is a partial cross-sectional view of a cutter operating at a second rate of penetration in a well bore, the cutter constructed according to the cutter of FIGS. 34-37 and the section view taken transverse to a well bore.

In FIG. 39A, the edge 254 of cutter 250 is shown in cutting engagement with a geological formation 128. The depth of cut is moderate with the convex curved portion 255 and the relative peak 256 and a portion of the concave curve 257 fully engaged in the geological formation 128. This represents a moderate ROP. At the represented moderate ROP, the average back rake angle J is in a range of less than to about the same angle as the average back rake angle I of FIG. 38A. This results from the unique shape of the shaped cutter surface 252, wherein the depression or concave curved surface 257 between the relative peaks 256 and 258 is at essentially a very small back rake angle so that its contribution to the average back rake angle decreases, or does not significantly add to, the average back rake angle for the portion of the working surface engaged in the geological formation. Thus, according to this embodiment, without a substantial amount of added WOB, the ROP can be increased. The convex surface 255 at edge 254 provides good strength. The shaped surface 252 provides a moderately aggressive ROP without a significant increase in the WOB. The cutter is durable within the small to moderate range of cutting depths.

Figure 39B:
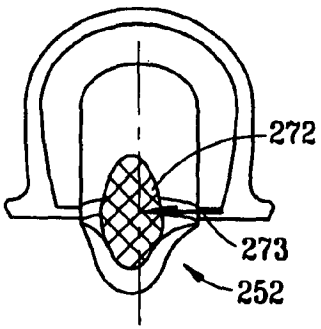
FIG. 39B is a side view of a cutter of FIG. 39A operating at the second ROP and showing the theoretical "foot print" of the cutter that engages the geological formation according to one aspect of the invention.

In FIG. 39B, the cutter 250 of FIG. 39A is shown operating at the moderate ROP with the shaped cutter surface 252 engaged at a moderate size foot print 272 in the geological formation 128. The foot print 272 is moderately sized so that the force on the cutter 250 that is generated by the footprint area and the normal force due to the average back rake angle J are also moderate. It will also be noted that the rounded shaped surface 252 "plows" through the formation and causes the cuttings or the chips from the formation to move sideways away from the surface 252. This reduces balling or buildup of chips on the cutter surface 252 and also facilitates heat dissipation. The side forces are not equal because the engaged relative peak 256 is offset from the center of the critical cutting region so that there is a net side loading 273. Thus, according to this embodiment of the invention, the shaped surface 252 can be usefully constructed to direct the cuttings or chips to one side or to the other side of the cutter 250. The directional cutting characteristic of the cutter 250 having a shaped surface 252 can also facilitate directional drilling, where the cutter 250 is appropriately positioned on a drill bit.

According to one aspect of the invention the total balance of forces on a drill bit or a balancing of work or a balancing of wear may be facilitated by designing or selecting particular shaped surfaces that provide a net force, or net work or chip flow, in one direction and balancing such a force with another shaped surface cutter having a net force, or net work or chip flow, in an opposing direction, or with a plurality of shaped surface cutters having net forces in opposing directions. The ability to balance forces, balance work, and balance wear is significantly enhanced by providing shaped working surface cutters according to this aspect of the invention.

According to another aspect of the invention, rather than balancing the forces on a drill bit to zero, the shaped cutter surfaces may be designed or selected and positioned on the drill bit to provide a net lateral or transverse force for a particular desired purpose. For example, a plurality of cutters, each having a shaped working surface to provide a net side force, may be appropriately positioned on a drill bit for purposes of directional drilling.

According to yet another aspect of the invention, the shape of the surface can be designed or selected to change with depth of cut so that the force direction at different depths of cutting might be controlled by the initial working shape of the cutter.

According to yet another aspect of the invention, the shape of the surface can be designed or selected to change with wear so that the force direction after different amounts of wear might be controlled by the initial working shape of the cutter.

Figure 39C:
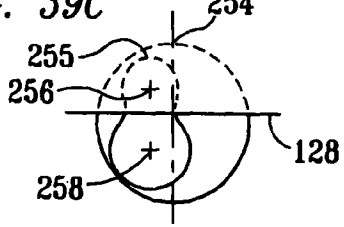
FIG. 39C is a top view of the cutter of FIGS. 39A and 39B operating at the second ROP and showing the hidden portion of the cutter that would engage the geological formation in a well bore.

FIG. 39C schematically demonstrates that the edge 254, the convex curved portion 255, and the convex curved relative peak 256 are engaged in the geological formation 128.

Figure 40A:
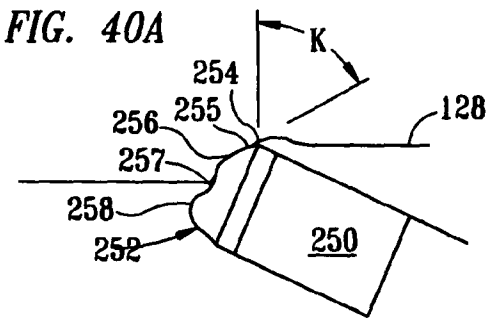
FIG. 40A is a partial cross-sectional view of a cutter operating at a third rate of penetration in a well bore, the cutter constructed according to the cutter of FIGS. 34-37 and the section view taken transverse to a well bore.

In FIG. 40A, the edge 254 of cutter 250 is shown in cutting engagement with a geological formation 128. The depth of cut is relatively large or aggressive with the first convex curved portion 255, the relative peak 256, and a large portion of second concave curve 257 fully engaged in the geological formation 128, representing a relatively large ROP. At the represented large ROP, the average back rake angle K is larger than the average back rake angles I of FIGS. 38A and J of FIG. 39A.

Figure 40B:
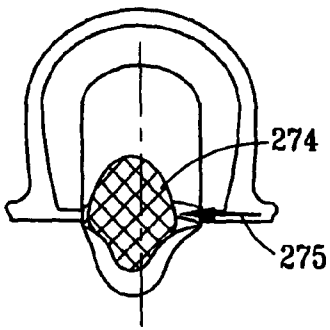
FIG. 40B is a side view of a cutter of FIG. 40A operating at the third ROP and showing the theoretical "foot print" of the cutter that engages the geological formation according to one aspect of the invention.

In FIG. 40B, the cutter 250 of FIG. 40A is shown operating at the large ROP with the shaped cutter surface 252 engaged at a large size foot print 274 in the geological formation 128. The foot print 274 has a relatively large area so that the force on the cutter 250 that is generated by the footprint area and the normal force due to the average back rake angle K are also large. A large side loading force vector 275 also results. It will be understood that the steepness of the concave portions 255 and 256 (as shown in FIG. 40A) progressively decreases with the depth of cut until more than about one-half of the concave curve portion 257 becomes engaged. The area of engagement 274 increases with the depth of the cut. As the depth of cut increases, the back rake angle J first decreases and tends to reduce the average back rake angle counter act the increase in footprint area 272 so that the WOB is not increased as much as might be expected for the amount of depth increase with a flat working surface. This usefully facilitates a range of cutting depths that does not dramatically change the cutting characteristics of the drill bit on which the shaped cutters are mounted. The shaped surface 252 therefore provides good cutting even with unexpected or sudden changes in ROP. If the ROP increases significantly the second half of the concave curve surface 257 is encountered to resist penetration and stabilize the bit.

Figure 40C:
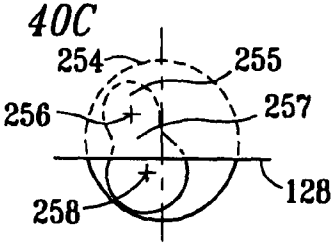
FIG. 40C is a top view of the cutter of FIGS. 40A and 40B operating at the third ROP and showing the hidden portion of the cutter that would engage the geological formation in a well bore.

FIG. 40C schematically demonstrates that the edge 254, the concave curved portion 255, the concave relative peak 256, and the concave curved portion 257 leading down from relative peak 256 and partially up toward the relative peak 258 are engaged in the geological formation 128.

FIG. 41 is a front view of another alternative embodiment of a cutter 280 having an ultra hard shaped working surface 282, wherein the shape of the working surface has a plurality of relative peaks 286 and 288 according to another alternative embodiment of the present invention.

FIG. 42 shows a side view of the shaped cutter surface 282 of the cutter 280 of FIG. 41.

FIG. 43 shows a back view of the shaped cutter surface 282 of the cutter 280 of FIG. 41.

FIG. 44 is a top partial section view of the shaped cutter surface 282 of the cutter of FIG. 41 taken along a section line 44-44 laterally through the shaped surface 282, halfway between the highest point 288 and the lowest point on the surface 294.

FIG. 45 is a front view of an alternative embodiment of a cutter 300 having an ultra hard shaped working surface 302, wherein the shape of the working surface 302 has an axially asymmetrical compound curved shape according to another alternative embodiment of the present invention.

FIG. 46 is a side view of the shaped cutter surface 302 of the cutter 300 of FIG. 45.

FIG. 47 is a back view of the shaped cutter surface 302 of the cutter 300 of FIG. 45.

FIG. 48 is a top partial section view of the shaped cutter surface 302 of the cutter of 300 FIG. 45 taken along a section line 48-48 laterally through the shaped surface halfway between the highest point 306 and the lowest point 304 on the surface 302.

Figure 49:
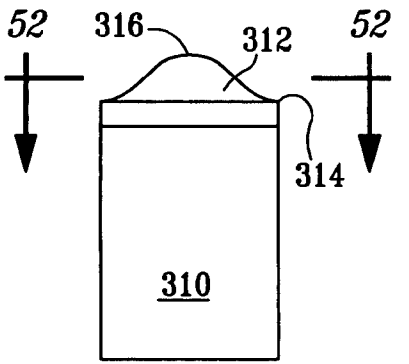
FIG. 49 is a front view of a cutter having an ultra hard shaped working surface, wherein the shape of the working surface is axially asymmetrical according to another alternative embodiment of the present invention.
Figure 50:
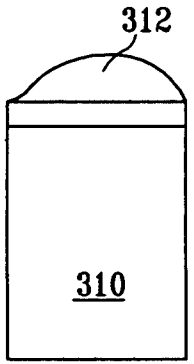
FIG. 50 is a side view of the cutter of FIG. 49.

FIG. 49 is a front view of the cutter 310 having an ultra hard shaped working surface 312, wherein the shape of the working surface 312 is axially asymmetrical according to another alternative embodiment of the present invention;

FIG. 50 is a side view of the shaped cutter surface 312 of the cutter 310 of FIG. 49.

Figure 51:
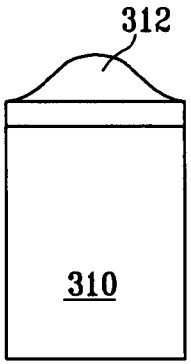
FIG. 51 is a back view of the cutter of FIG. 49.

FIG. 51 is a back view of the shaped cutter surface 312 of the cutter 310 of FIG. 49.

Figure 52:
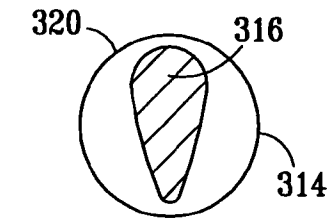
FIG. 52 is a top partial section view of the cutter of FIG. 49 taken along a section line 52-52 laterally through the shaped surface halfway between the highest point and the lowest point on the surface.

FIG. 52 is a top partial section view of the cutter 310 of FIG. 49 taken along a section line 52-52 laterally through the shaped surface 312, halfway between the highest point 316 and the lowest point 314 on the surface 312.

Figure 53:
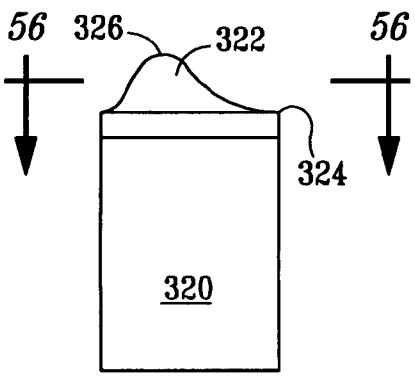
FIG. 53 is a front view of a cutter having an ultra hard shaped working surface, wherein the shape of the working surface is axially asymmetrical according to another alternative embodiment of the present invention.

FIG. 53 is a front view of a cutter 320 having an ultra hard shaped working surface 322, wherein the shape of the working surface 322 is axially asymmetrical according to another alternative embodiment of the present invention.

Figure 54:
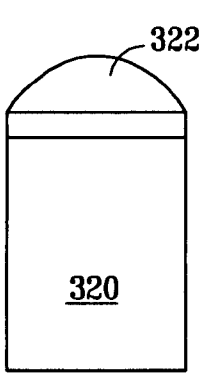
FIG. 54 is a side view of the cutter of FIG. 53.

FIG. 54 shows a side view of shaped working surface 322 of the cutter of 320 of FIG. 53.

Figure 55:
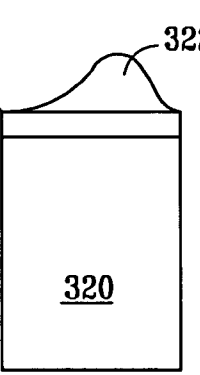
FIG. 55 is a back view of the cutter of FIG. 53.

FIG. 55 shows a back view of the shaped working surface 322 of the cutter of 320 of FIG. 53.

Figure 56:
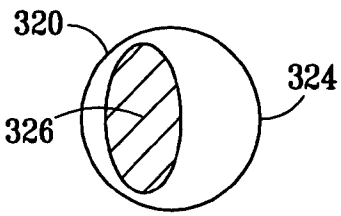
FIG. 56 is a top partial section view of the cutter of FIG. 53 taken along a section line 56-56 laterally through the shaped surface halfway between the highest point and the lowest point on the surface.

FIG. 56 shows a top partial section view of the cutter surface 322 of the cutter 320 of FIG. 53 taken along a section line 56-56 laterally through the shaped surface 322 halfway between the highest point 326 and the lowest point 324 on the surface 322.

Figure 57:
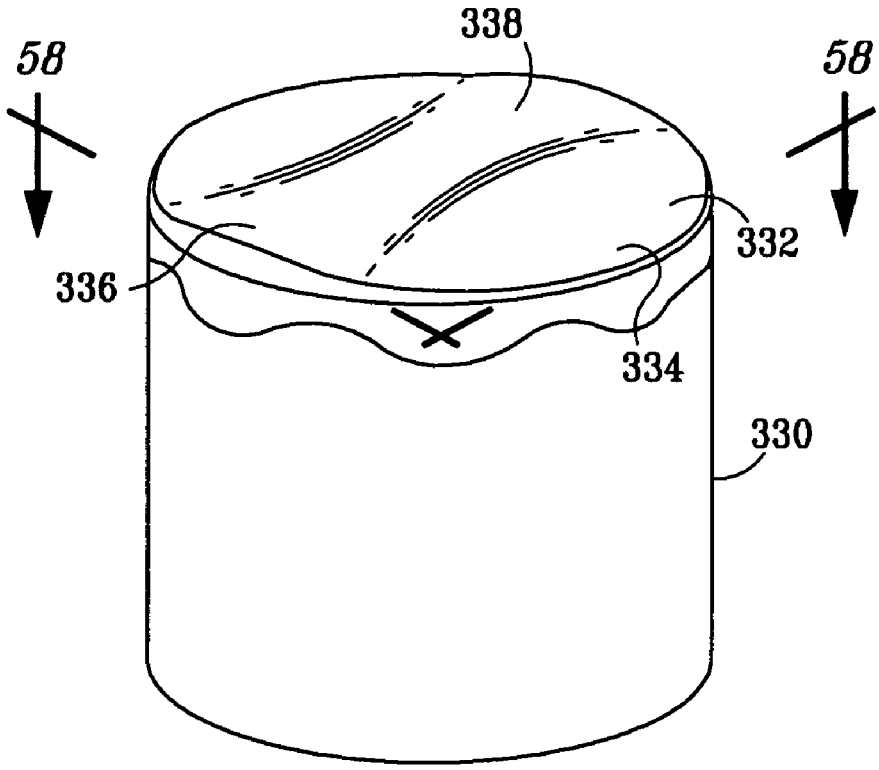
FIG. 57 is a perspective view of a cutter having an ultra hard shaped working surface, wherein the shape of the working surface is an axially asymmetrical compound curve with two relative high points according to one embodiment of the present invention.

FIG. 57 shows a perspective view of an alternative embodiment of a cutter 330 having an ultra hard shaped working surface 332, wherein the shape of the working surface 332 is an axially asymmetrical compound curve with two relative high points 336 and 338.

Figure 58:
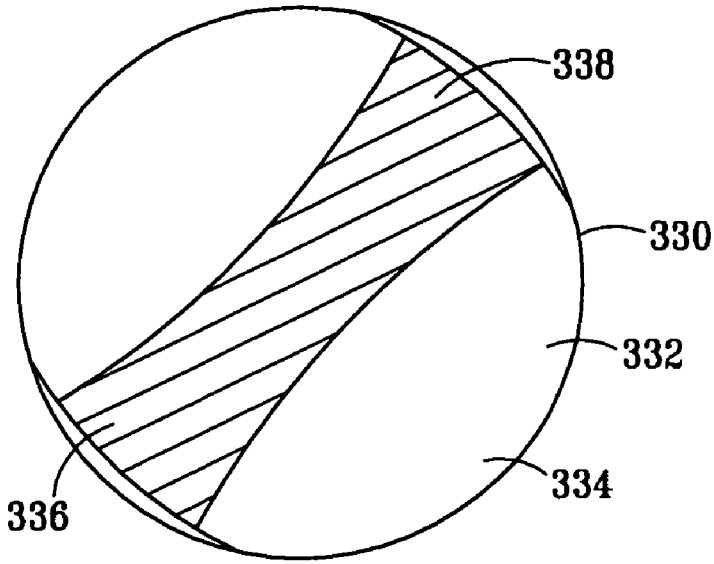
FIG. 58 is a partial cross-sectional view taken along a section line 58-58 perpendicular to the axis of the cutter of FIG. 57, halfway between the highest point and the lowest point on the working surface.

FIG. 58 shows a partial cross-sectional view of the working surface 332 of the cutter 330 taken along a section line 58-58 perpendicular to the axis of the cutter 330 of FIG. 57, halfway between the highest point 338 and the lowest point 334 on the working surface 332.

Figure 59:
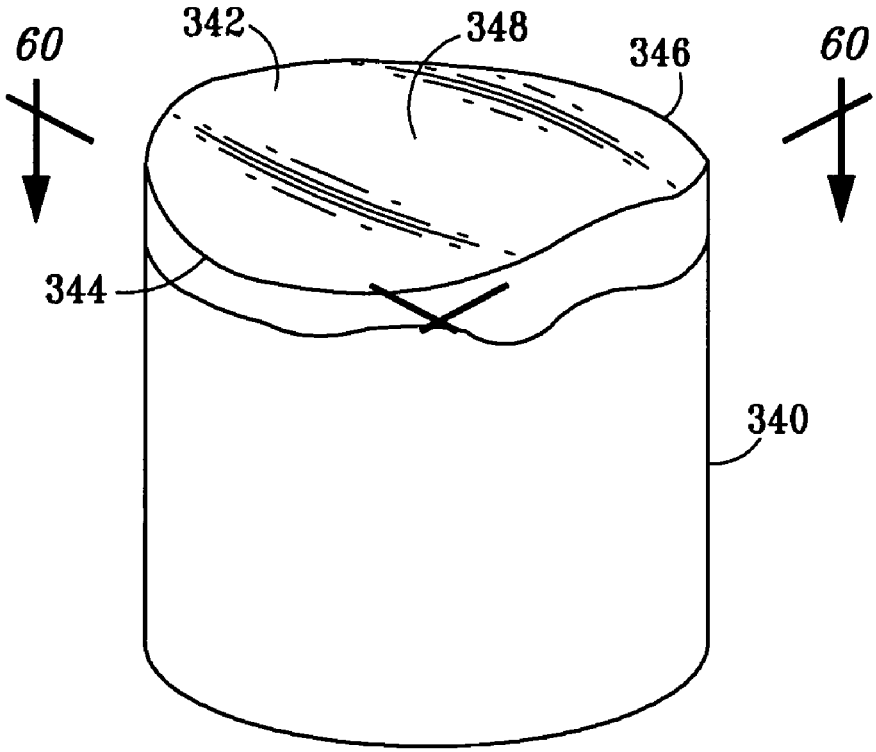
FIG. 59 is a perspective view of a cutter having an ultra hard shaped working surface, wherein the shape of the working surface is an axially asymmetrical compound curve with two relative low points according to one embodiment of the present invention.

FIG. 59 shows a perspective view of an alternative embodiment of a cutter 340 having an ultra hard shaped working surface 342, wherein the shape of the working surface 342 is an axially asymmetrical compound curve with two relative low points 344 and 346 at different locations relative to a high point 348.

Figure 60:
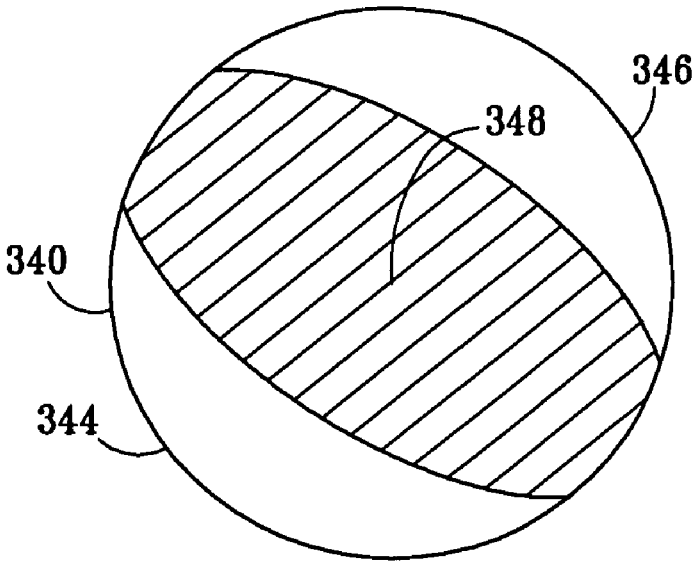
FIG. 60 is a partial cross-sectional view taken along a section line 60-60 perpendicular to the axis of the cutter of FIG. 59, halfway between the highest point and the lowest point on the working surface.

FIG. 60 is a partial cross-sectional view taken along a section line 60-60 perpendicular to the axis of the cutter 340 of FIG. 59, halfway between the highest point 348 and the lowest point 344 on the working surface 342.

Figure 61:
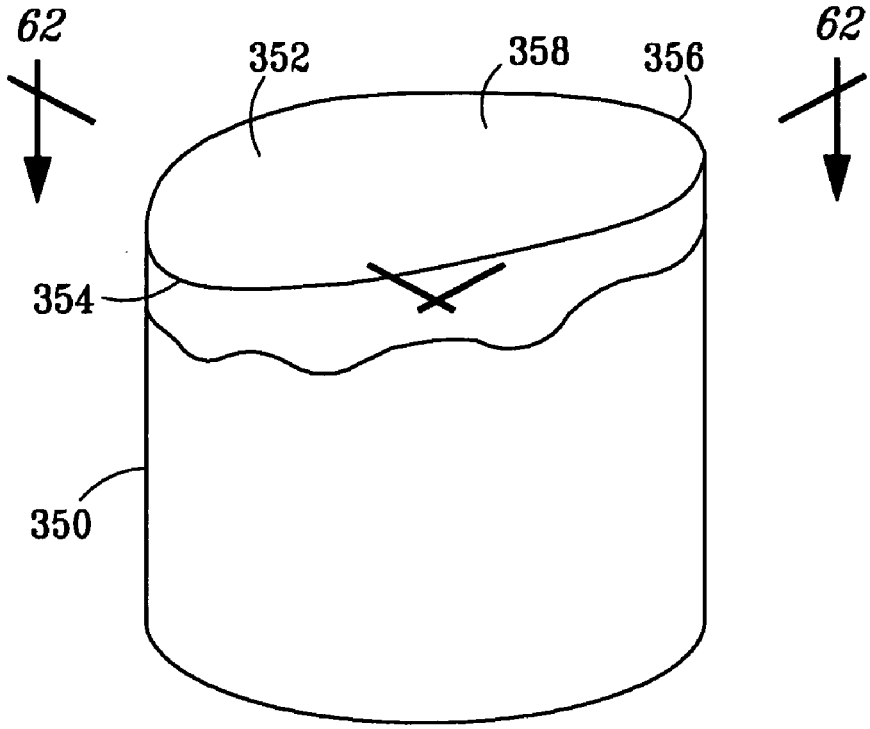
FIG. 61 is a perspective view of a cutter having an ultra hard shaped working surface, wherein the shape of the working surface is an axially asymmetrical compound curve with two relative low points according to one embodiment of the present invention.

FIG. 61 is a perspective view of another alternative cutter 350 having an ultra hard shaped working surface 352, wherein the shape of the working surface 352 is an axially asymmetrical compound curve with two relative low points 354 and 356 at different locations relative to a high point 358.

Figure 62:
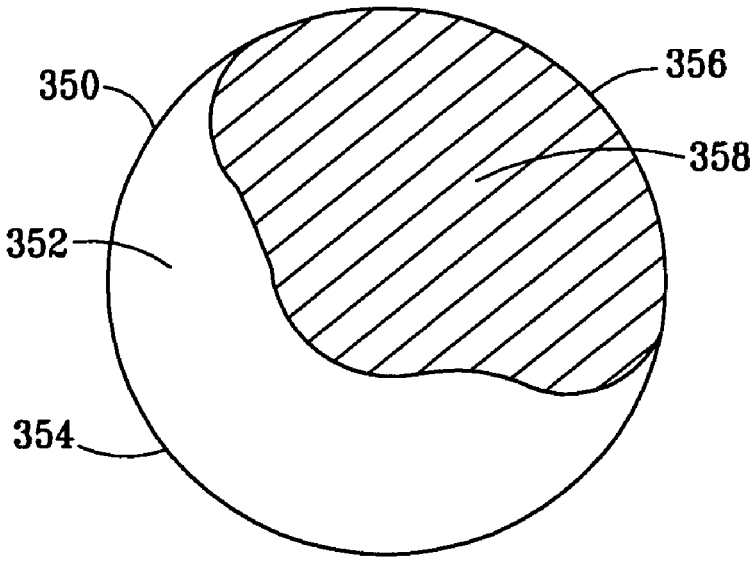
FIG. 62 is a partial cross-sectional view taken along a section line 62-62 perpendicular to the axis of the cutter of FIG. 61, halfway between the highest point and the lowest point on the working surface.

FIG. 62 shows a partial cross-sectional view of the shaped surface 352 taken along a section line 62-62 perpendicular to the axis of the cutter 350 of FIG. 61, halfway between the highest point 358 and the lowest point 354 on the working surface 352.

Figure 63:
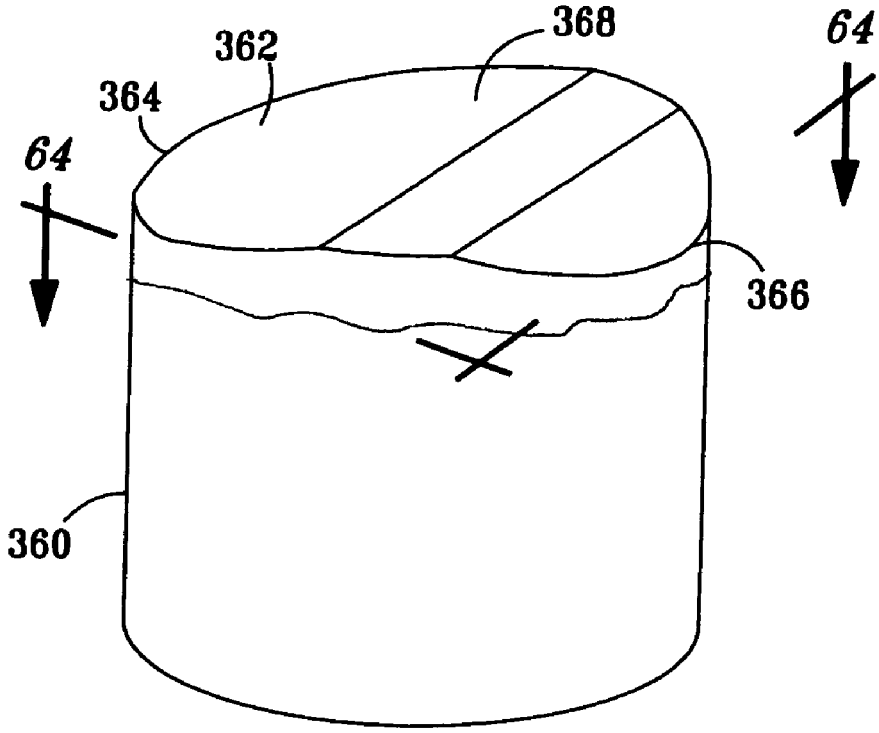
FIG. 63 is a perspective view of a cutter having an ultra hard shaped working surface, wherein the shape of the working surface is an axially asymmetrical compound curve with two relative low points according to one embodiment of the present invention.

FIG. 63 shows a perspective view of an alternative embodiment of a cutter 360 having an ultra hard shaped working surface 362, wherein the shape of the working surface 362 is an axially asymmetrical compound curve with two relative low points 364 and 366.

Figure 64:
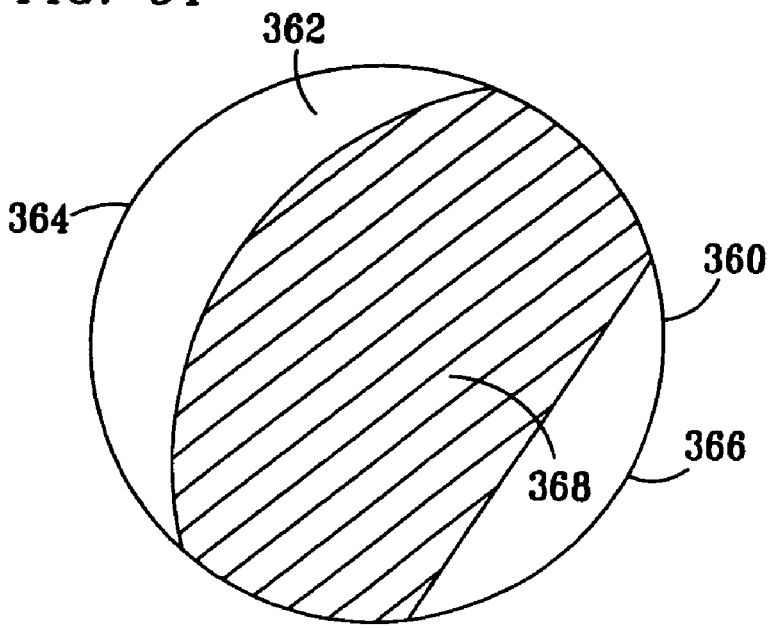
FIG. 64 is a partial cross-sectional view taken along a section line 63-63 perpendicular to the axis of the cutter of FIG. 63, halfway between the highest point and the lowest point on the working surface.

FIG. 64 is a partial cross-sectional view taken along a section line 64-64 perpendicular to the axis of the cutter of FIG. 63, halfway between the highest point 368 and the lowest point 364 on the working surface.

Figure 65:
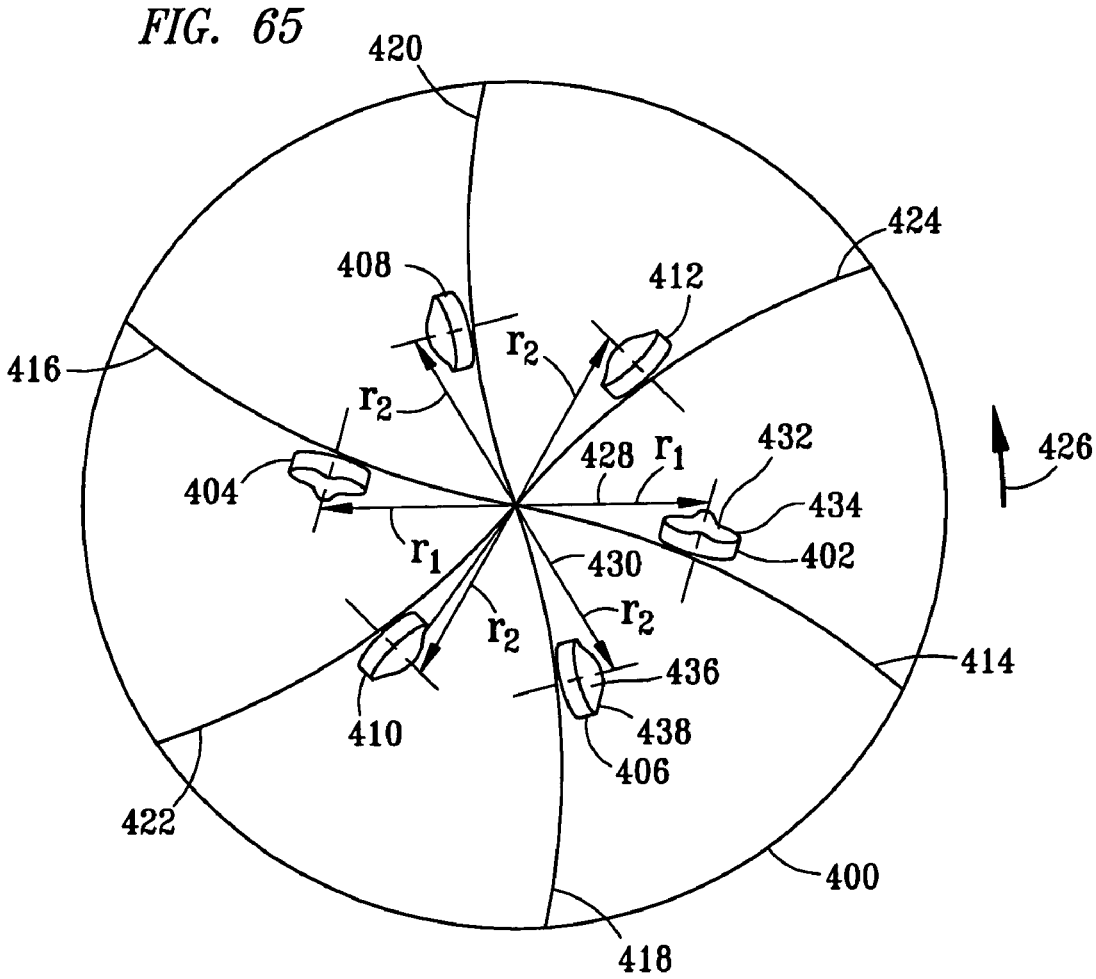
FIG. 65 is a schematic depiction of cutters at selected radial positions on blades of a hypothetical drill bit to demonstrate opposed dual set cutters and leading-trailing dual set cutters.

FIG. 65 schematically shows an example of a hypothetical drill bit 400 with selected cutters 402, 404, 406, 408, 410 and 412 at selected radial positions r1 and r2 on blades 414, 416, 418, 420, 422, and 424, respectively. The blades are schematically represented by lines tracing the blade profile in this end view. Cutters 402 and 404 are at the same radial positions r1 from the center of the drill bit face, such that cutters 402 and 404 demonstrate opposed dual set cutters. Assuming the blade profile shape is the same for opposed blades 414 and 416, the opposed dual set cutters 402 and 404 will each cut in spiral paths having the same shape and at the same depth depending upon the ROP and RPM of the drill bit. Cutters 406 and 408 are similarly opposed dual set cutters each at a position defined by radius r1 and the profile shape of the blades 418 and 420 respectively. In this example cutters 406 and 408 are also leading cutters because they are followed during drilling by trailing cutters 410 and 412, each at the same radius r2 on the blades 422 and 424. Trailing blades 422 and 424 follow leading blades 418 and 420, respectively, in the direction of cutting 426. Thus, assuming the blades have the same profile shape, the trailing dual set cutter 410 will follow in the same spiral path as the leading cutter 406 and the trailing cutter 412 will follow in the same spiral path as leading cutter 408. Because the leading cutters 406 and 408 traverses a greater cutting distance as they cut into the formation, compared to the cutting distance traversed by the trailing cutters 410 and 412, the leading cutters 406 and 408 will have a greater depth of cut than the trailing cutters 410 and 412. It has been found according to one embodiment of the invention that varying the shaped working surface and having a different shaped working surface for a leading cutter and a trailing cutter may be useful. For example, a leading cutter that cuts deeper than a corresponding trailing cutter may benefit from a shaped working surface with a large amount of curvature at the critical engaged edge area of the cutter. The large curvature can effectively increase the back rake angle to help protect the working surface from delaminating, chipping, and spalling as discussed above.

Figure 66:
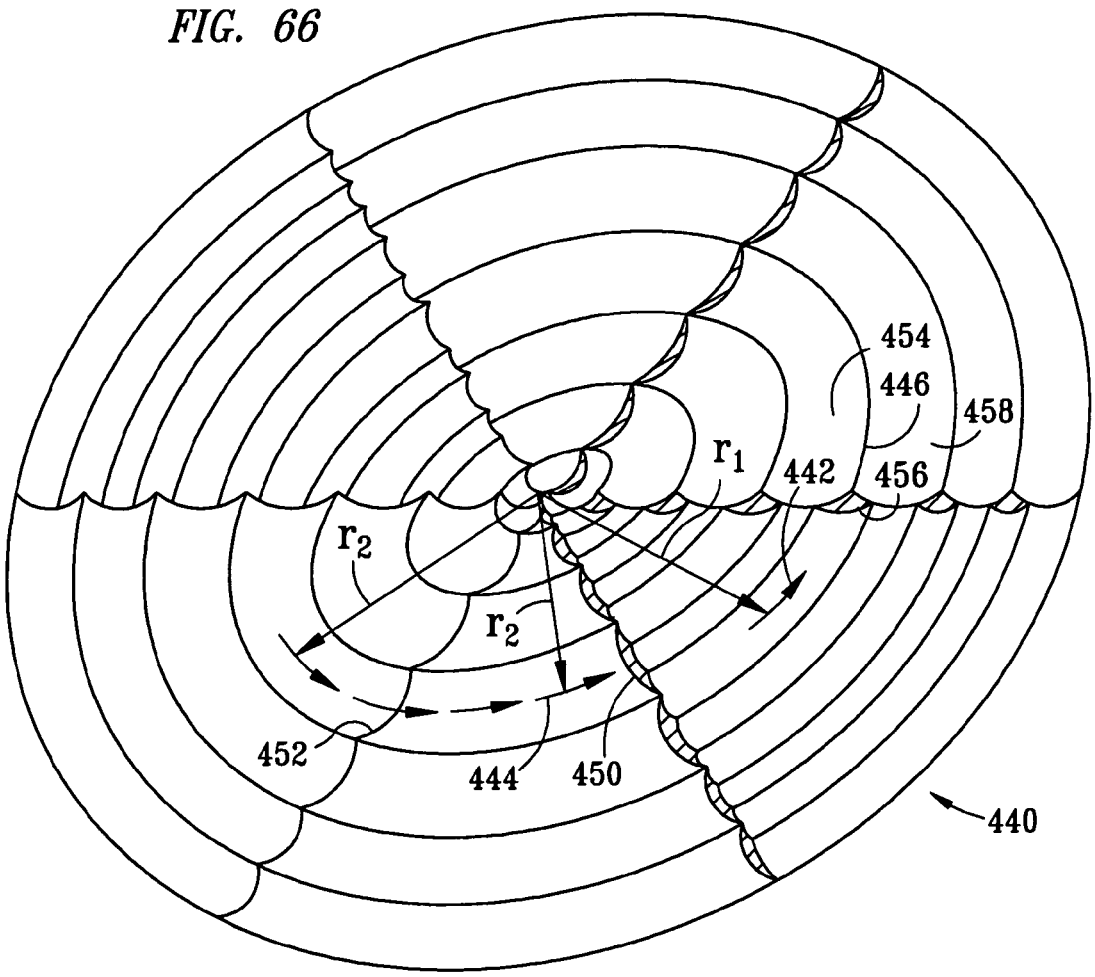
FIG. 66 is a schematic perspective view of a predicted partial bottom hole cutting pattern for a hypothetical drill bit with dual set cutter placement similar to the placement shown in FIG. 65.

FIG. 66 shows an example of a predicted partial bottom hole cutting pattern 440 for a hypothetical drill bit with repeated dual set cutter placement similar to the placement shown in FIG. 65. For example, cutter 402 of FIG. 65, positioned on the drill bit 400 at radius r1, produces a cutting path 442. The cutting path 442 traveled by cutter 402 is offset from a trough 454 formed by cutter 406 so that the ridge 446 between adjacent cutting paths 454 and 458 is engaged by a central portion of cutter 402. FIG. 66 also shows cutter 406 of FIG. 65 that produces a cutting path 444 at a radius r2 and trailing cutter 410 that follows along the same general cutting path at the radius r2 and cutting only slightly deeper than leading cutter 406. A cut engagement shape 448 shows the interface between the cutter 402 and the formation. Similarly the cut engagement pattern 450 shows the cutter/formation engagement interface formed by the leading cutter 406. Shape 450 is predicted in this embodiment to have a deep central area and shallower sides. A more uniform arc shape cutter/formation interface would be encountered by the trailing cutter 410 of FIG. 65. One reason for a trailing dual set cutter is to retain a sharp cutting edge in the event the leading cutter is damaged or in the event that an unexpected increase in depth of cut or ROP occurs while drilling. The shallow depth of cut therefore reduces that stress and wear on the trailing cutter so that it remains sharp until it might be needed later for heavy cutting, for example, after the leading cutter wears of becomes damaged.

FIG. 67 shows an example of a cutter 460 with a shaped working surface 462. A portion 464 of the shaped working surface 462 is engaged in drilling a formation 74 at a bottom hole with a depth of cut 466. The average curvature of the shaped working face 468 establishes an effective back rake angle 470 relative to a perpendicular 472 to the formation surface. It has been found by the inventors that a back rake angle 474 for the edge of the shaped working surface 468 that is larger than the nominal back rake angle 470 generally provides protection to the cutter against certain failure modalities and mechanisms. The curvature of the portion of the shaped working surface 468 that is engaged with the formation 74, as that curvature may be indicated by an average slope of the curved working surface, can be generally considered to establish an effective back rake angle 480. The effective back rake angle can be considered for purposes of approximating the cutting forces, the stress, and the wear on the cutter. It will be understood by those skilled in the art based upon this disclosure that specific calculations of forces integrated or otherwise summed over the shaped working surface that is engaged in the formation can also be made, and the calculated results can be combined to give the effective forces and the effective stresses. Thus, considering an average slope to find an effective back rake angle or making specific calculations can provide similar results in many cases. The theoretical effective back rake angle produced by the portion of the shaped working surface engaged in the formation is further helpful for understanding the usefulness of a shaped working surface that is designed, selected, or otherwise provided in accordance with the pattern of the cutter/formation interface, or for purposes of matching various desired back rake angles to various depths of cut along any portion of the cutter working surface during drilling.

FIG. 68 shows a predicted cutter/formation engagement pattern 450 (as shown in FIG. 66 for a leading cutter 406 or as shown in FIG. 67 for a single set cutter 460) in an example dual set drill bit 400 (shown in FIG. 65). There are various depths of cut indicated at 450A, 450B, 450C and 450D along the interface pattern 450.

FIG. 69 is a top view of an example of the face 468 and a shaped working surface 462 for a cutter 460 according to one embodiment of the invention. The cutter 460 may correspond to or may usefully replace a leading cutter 406 (shown in FIG. 65) in a dual set drill bit or it may be a single set cutter. In this embodiment the curvature of the shaped working surface is made to vary according to the depths of cut expected or predicted. A curvature at 462A is relatively flat to correspond to the shallow depth 450A. Convex curvatures at 462B and 462C are relatively severe corresponding to the deep cut depths 450B and 450C. A curvature 462D is relatively flat corresponding to the shallow depth 450D. (The depths are shown in FIG. 68).

FIG. 70A-D shows a series of side views of the cutter 460 of FIG. 67, each at different points around the engaged cutter edge so that various portions 462A, 462B, 462C, and 462D of the shaped working surface 462 and the face 468 are shown engaged at different depths 450A, 450B, 450C, and 450D as predicted for the cutter/formation engagement pattern 450 of FIG. 24.

Figure 71:
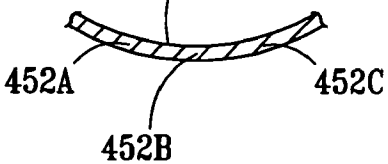
FIG. 71 is a schematic depiction of a predicted cutter/formation engagement pattern for a leading cutter in a dual set drill bit.

FIG. 71 shows an alternatively predicted cutter/formation engagement pattern 452 for a trailing cutter in a dual set drill bit. The shape of the pattern 452 is characterized by shallow depth of cut along the entire engaged critical area. For example depth 452A, 452B, and 452C are all about equal in this embodiment.

Figure 72:
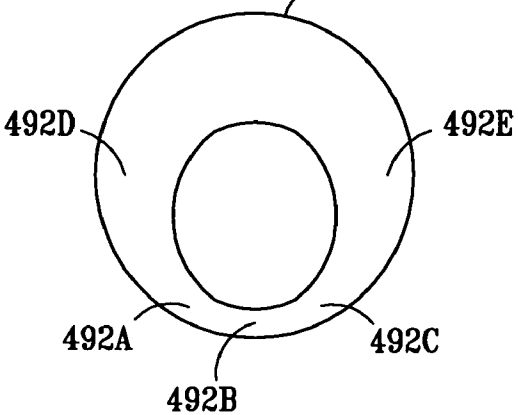
FIG. 72 is a top view of the face of an example of a shaped working surface cutter for a trailing cutter in a dual set drill bit useful for the cutter/formation pattern of FIG. 71 according to one embodiment of the invention.

FIG. 72 shows an example of a shaped working surface cutter 490 for a trailing cutter in a dual set drill bit similar to the cutter 410 in FIG. 65 that is useful for the cutter/formation pattern 452 of FIG. 27 according to one embodiment of the invention. A face 492 is circumscribed by a shaped working surface 492. The shaped working surface has substantially similar curvature 492A, 492B, and 492C in the area corresponding to the predicted cut pattern 450. Those skilled in the art will understand based upon the entire disclosure that shaped working surface curvature or shapes 492D and 492E may usefully vary for other purposes, for example so that unexpected deeper cuts are met with increased shaped working surface curvature and therefore effective back as described above and as further indicated in connection with FIG. 74 below.

Figure 73C:
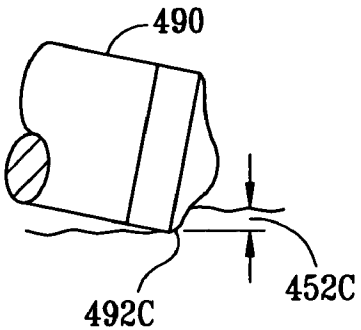
FIGS. 73A-C shows a series of side views of the trailing cutter of FIG. 72 with various portions of the shaped working surface engaged at different depths predicted for the cutter/formation engagement pattern of FIG. 71.
Figure 73B:
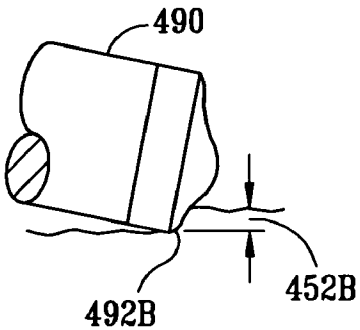
Figure 73A:
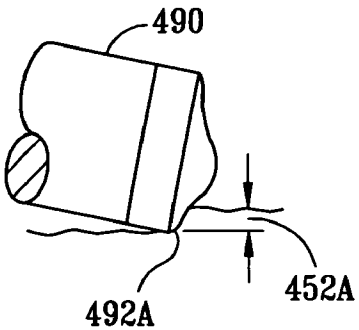

FIGS. 73A-C shows a series of side views of the trailing cutter 490 of FIG. 28 with various portions of the shaped working surface 492A, 492B, and 492C, respectively, engaged at different depths 452A, 452B, and 452C as predicted for the cutter/formation engagement pattern 452 of FIG. 71.

Figure 74:
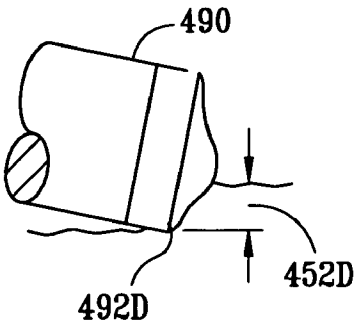
FIG. 74 is a side view of a cutter having a shaped working surface engaged at a greater depth than the typically predicted depth for the expected cutter/formation engagement pattern of FIG. 71 under normal conditions.

FIG. 74 is a side view of the cutter 490 having a shaped working surface 492 engaged at a depth 494 greater than the typically predicted depths 452A-C for the expected cutter/formation engagement pattern 452 of FIG. 71 under normal conditions. Thus, for example, a shaped working surface portion 492D with a greater convex curvature may act to change the effective back rake angle when unexpected deep cutting occurs. This can helps to reduce gouging into the formation, it can direct the flow of formation cuttings, it can reduce the impact of a sudden deeper cut, and it can help limit the further increase in depth of cut.

Figure 75:
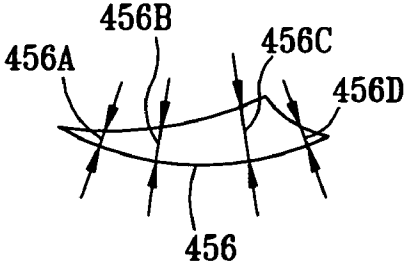
FIG. 75 is a schematic depiction of an example of a predicted cutter/formation engagement pattern for a cutter offset from a preceding cutter in a drill bit.
Figure 77D:
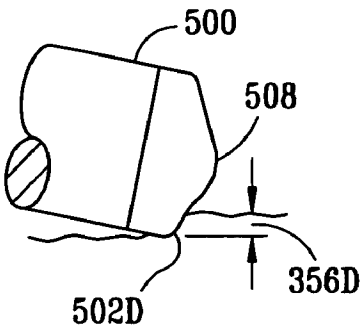
FIGS. 77A-D shows a series of side views of the cutter of FIG. 76 with various portions of the shaped working surface engaged at different depths predicted for the cutter/formation engagement pattern of FIG. 75.
Figure 77C:
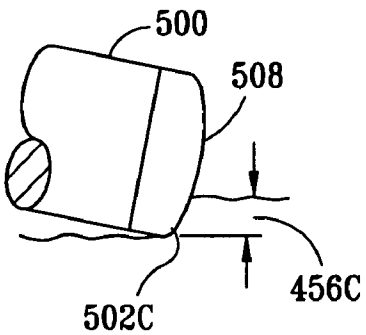
Figure 77B:
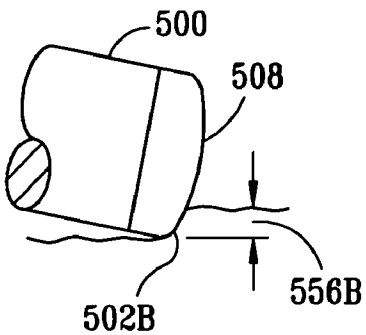
Figure 77A:
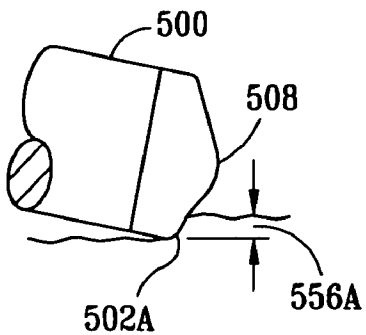

FIG. 75 shows an example of a predicted cutter/formation engagement pattern 456 (as shown in FIG. 22) for a cutter, similar to cutter 402 as in an example drill bit 400 (shown in FIG. 21), that might be offset radially from a preceding cutter.

The pattern 456 shows varying depths at 456A, 456B, 456C and 456D along the critical area of engagement with a formation.

Figure 76:
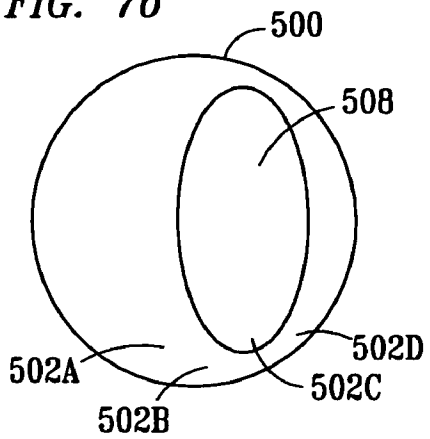
FIG. 76 is a top view of the face of an example of a variable chamfer cutter for a drill bit useful for the cutter/formation pattern of FIG. 75 according to one embodiment of the invention.

FIG. 76 is a top view of an example of the face 508 having a shaped working surface with varied curvature 502 for a cutter 500 according to one embodiment of the invention. The cutter 500 may correspond to or may usefully replace an offset cutter 402 in an opposed cutter dual set drill bit or might be any cutter that is offset from the path of a preceding cutter. In this embodiment the curvature of the shaped working surface 502 is made to vary. A curvature at 502A is relatively flat (i.e., a larger radius) to correspond to the shallow depth 456A. Curvatures at 502B and 502C are greater (i.e., a smaller radius) wider to correspond to the deep cut depths 456B and 456C. A width 502D is relatively narrow corresponding to the shallow depth 456D. (The depths are shown in FIG. 31).

FIGS. 77A-D show a series of side views of the cutter 500 of FIG. 76 each at different points around the engaged cutter edge so that various portions 502A, 502B, 502C, and 502D of the shaped working surface 502 of the face 508 are shown engaged at different depths 456A, 456B, 456C, and 456D as predicted for the cutter/formation engagement pattern 456 of FIG. 75.

Figure 78:
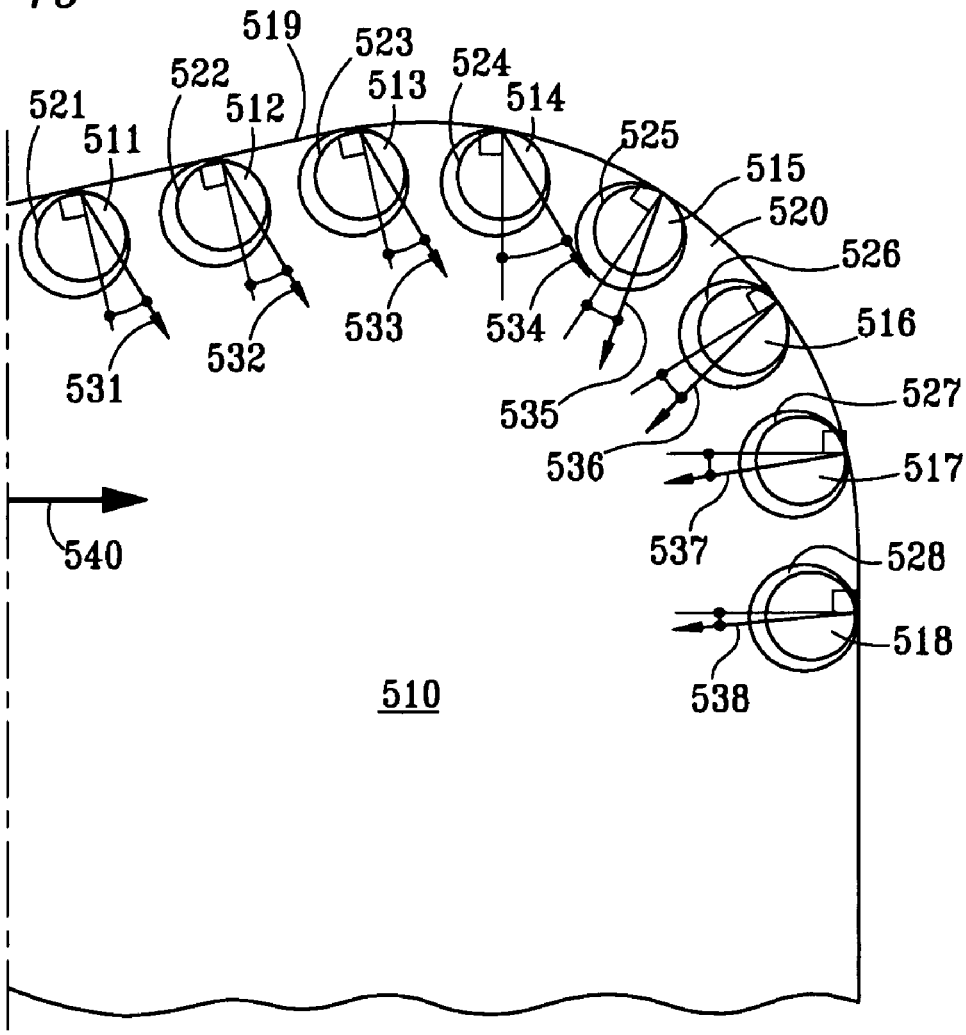
FIG. 78 is a schematic depiction of a cutter profile for one blade of a drill bit cutter showing an example of a plurality of shaped working surface cutters arranged to provide force on the cutters in a direction at an angle other than normal to the engaged formation surface so that a total side force results on the drill bit.

FIG. 78 shows an example of a drill bit 510 having a plurality of cutters 511, 512, 513, 514, 515, 516, 517, and 518. The cutters are variously provided with varied geometry chamfers and are positioned along the profile 520 with the chamfers 521, 522, 524, 523, 524, 525, 526, 527, and 528 oriented to provide vector forces 531, 532, 533, 534, 535, 536, 537, and 538 on the cutters, respectively, in directions at angled with respect to the normal to the engaged formation surface along the profile 520. When drilling with the drill bit 510, the varied chamfers (larger inward and smaller outward) the of cutters 511, 512, 513, and 514 along the cone 519 of the drill bit 510 produce greater combined outward directed side force than the combined inward directed side force produced by cutters 515, 516, 517, and 518. A total outward directed side force 540 can therefore be made using the variable chamfer cutters according to one embodiment of the invention. Such an outward directed side force 540 can be useful for designing and making a drill bit that has controlled walking characteristics, as for example for purposes of directional drilling. It will be understood by those skilled in the art based upon this disclosure that a varied shaped working surface according to other embodiments of the invention may be arranged to provide any number of possible resultant total forces on a drill bit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should include not only the embodiments disclosed but also such combinations of features now known or later discovered, or equivalents within the scope of the concepts disclosed and the full scope of the claims to which applicants are entitled to patent protection.

What is claimed is:

1. A cutter for an earth boring drag bit, the cutter comprising:

an ultrahard material layer bonded to a substrate, the ultrahard material layer comprising a peripheral side surface and a shaped working surface, said working surface intersecting said peripheral side surface, wherein a peripheral edge is defined by said intersection, said peripheral edge forming at least a cutting edge, wherein the shaped working surface comprises an axially asymmetrical curved surface, the axially asymmetrical curved surface comprising a smoothly continuous compound curve, wherein the smoothly continuous compound curve comprises a continuously curving convex portion and concave portions extending from opposite sides of said convex portion, wherein any first point on the peripheral edge intersected by an axial plane extending across the convex portion and the concave portions and through a central axis of said ultrahard material layer is at a level as measured axially from a second point on the convex portion that is at a distance from said first point no less than all levels of the concave portions along said plane as measured axially from said second point.

2. The cutter of claim 1, wherein the shaped working surface comprises a high point and a low point in an axial direction and wherein an imaginary cross-section, taken through the shaped working surface perpendicular to the axial direction and halfway between the high point and the low point, has an area that is greater than about 20% of the total area of the shaped working surface.

3. The cutter of claim 1, wherein the shaped working surface comprises a high point and a low point in an axial direction and wherein an imaginary cross-section, taken through the shaped working surface perpendicular to the axial direction and halfway between the high point and the low point, has a perimeter length that is greater than about 20% of a perimeter of the shaped working surface.

4. The cutter of claim 1, wherein the shaped working surface comprises a high point and a low point in an axial direction and wherein an imaginary cross-section, taken through the shaped working surface perpendicular to the axial direction and halfway between the high point and the low point, has an area that is greater than about 50% of a total area of the shaped working surface.

5. The cutter of claim 1, wherein the shaped working surface comprises a high point and a low point in an axial direction and wherein an imaginary cross-section, taken through the shaped working surface perpendicular to the axial direction and halfway between the high point and the low point, has a perimeter length that is greater than about 50% of a perimeter of the shaped working surface.

6. The cutter of claim 1, wherein the shaped working surface comprises a relative high point inward from the peripheral edge of the ultrahard material layer, the relative high point defined by a convex curved surface portion that is connected to the peripheral edge of the ultrahard material layer with a concave curved surface.

7. The cutter of claim 1 wherein the edge is defined by the intersection of a linearly extending surface of the ultrahard material layer and the working surface.

8. The cutter of claim 1 wherein the peripheral edge is axially asymmetrical.

9. The cutter of claim 1 wherein said at least a cutting edge includes a portion of said peripheral edge that is higher than a majority of the remainder of the peripheral edge as measured from the substrate.

10. The cutter of claim 1 wherein the convex portion is elongated in plan view and is diametrically symmetrical about a diameter of said cutter spanning a longest span of said convex portion.

11. A cutter for an earth boring drag bit, the cutter comprising:

an ultrahard material layer bonded to a substrate, the ultrahard material layer comprising a peripheral side surface and a shaped working surface, said working surface intersecting said peripheral side surface, wherein a peripheral edge is defined by said intersection surrounding said working surface, said peripheral edge forming at least a cutting edge, wherein the shaped working surface comprises a high point and a low point in an axial direction and wherein an imaginary cross-section, taken through the shaped working surface perpendicular to the axial direction and halfway between the high point and the low point, has an area that is greater than about 20% of a total area of the shaped working surface wherein the working surface comprises an axially asymmetrical curved surface comprising a continuously curving convex portion and concave portions extending from opposite sides of said convex portion, wherein any first point on the peripheral edge intersected by an axial plane extending across the convex portion and the concave portions and through a central axis of said ultrahard material layer is at a level as measured axially from a second point on the convex portion that is at a distance from said first point no less than all levels of the concave portions along said plane as measured axially from said upper point.

12. The cutter of claim 11 wherein the edge is defined by the intersection of a linearly extending surface of the ultrahard material layer and the working surface.

13. The cutter of claim 11 wherein the peripheral edge is axially asymmetrical.

14. The cutter of claim 11 wherein said at least a cutting edge includes a portion of said peripheral edge that is higher than a majority of the remainder of the peripheral edge as measured from the substrate.

15. The cutter of claim 11 wherein the convex portion is elongated in plan view and is diametrically symmetrical about a diameter of said cutter spanning a longest span of said convex portion.

16. A cutter for an earth boring drag bit, the cutter comprising:

an ultrahard material layer bonded to a substrate, the ultrahard material layer comprising a peripheral side surface and a shaped working surface, said working surface intersecting said peripheral side surface, wherein a peripheral edge is defined by said intersection surrounding said working surface, said peripheral edge forming at least a cutting edge, wherein the shaped working surface comprises a high point and a low point in an axial direction and wherein an imaginary cross-section, taken through the shaped working surface perpendicular to the axial direction and halfway between the high point and the low point, has a perimeter length that is greater than about 20% of the perimeter of the shaped working surface wherein the working surface comprises an axially asymmetrical curved surface comprising a continuously curving convex portion and concave portions extending from opposite sides of said convex portion, wherein any first point on the peripheral edge intersected by an axial plane extending across the convex portion and the concave portions and through a central axis of said ultrahard material layer is at a level as measured axially from a second point on the convex portion that is at a distance from said first point no less than all levels of the concave portions along said plane as measured axially from said second point.

17. The cutter of claim 16 wherein the edge is defined by the intersection of a linearly extending surface of the ultrahard material layer and the working surface.

18. The cutter of claim 16 wherein the peripheral edge is axially asymmetrical.

19. The cutter of claim 16 wherein said at least a cutting edge includes a portion of said peripheral edge that is higher than a majority of the remainder of the peripheral edge as measured from the substrate.

20. The cutter of claim 16 wherein the convex portion is elongated in plan view and is diametrically symmetrical about a diameter of said cutter spanning a longest span of said convex portion.

21. An earth boring drag type drill bit comprising:

a bit body; and at least one cutter held by the bit body, the at least one cutter comprising an ultrahard material layer having a peripheral side surface and a shaped working surface, said working surface intersecting said peripheral side surface, wherein a peripheral edge is defined by said intersection surrounding said working surface, said peripheral edge forming at least a cutting edge, the shaped working surface including an axially asymmetrical curved surface comprising a continuously curving convex portion continuously curving convex portion and concave portions extending from opposite sides of said convex portion, wherein any first point on the peripheral edge intersected by an axial plane extending across the convex portion and the concave portions and through a central axis of said ultrahard material layer is at a level as measured axially from a second point on the convex portion that is at a distance from said first point no less than all levels of the concave portions along said plane as measured axially from said second point.

22. The drill bit of claim 21 further comprising a plurality of cutters having ultrahard working surfaces selectively positioned on the bit body, wherein the shaped surface and the positions of the plurality of cutters produces a balance of forces on the drill bit during operation.

23. The drill bit of claim 21 further comprising a plurality of cutters having ultrahard working surfaces selectively positioned on the bit body, wherein the shaped surface and the positions of the plurality of cutters produces a net unbalanced force on the drill bit during operation.

24. The drill bit of claim 21 further comprising a plurality of cutters having ultrahard working surfaces selectively positioned on the bit body, wherein the shaped surface and the positions of the plurality of cutters produces a net unbalanced force on the drill bit during operation to facilitate directional drilling.

25. The drill bit of claim 21 wherein the edge is defined by the intersection of a linearly extending surface of the ultrahard material layer and the working surface of said at least one cutter.

26. The bit of claim 21 wherein the peripheral edge is axially asymmetrical.

27. The bit of claim 21 wherein said at least a cutting edge includes a portion of said peripheral edge that is higher than a majority of the remainder of the peripheral edge as measured from the substrate.

28. The earth boring drag bit of claim 21 wherein the convex portion is elongated in plan view and is diametrically symmetrical about a diameter of said cutter spanning a longest span of said convex portion.

29. An earth boring drag type drill bit comprising:

a bit body; and at least one cutter held by the bit body, the at least one cutter having comprising an ultrahard material layer bonded to a substrate, the ultrahard material layer comprising a peripheral side surface and a shaped working surface, said working surface intersecting said peripheral side surface, wherein a peripheral edge is defined by said intersection surrounding said working surface, said peripheral edge forming at least a cutting edge, the shaped working surface including a high point and a low point in an axial direction of the cutter and wherein an imaginary cross-section, taken through the shaped working surface perpendicular to the axial direction of the cutter and halfway between the high point and the low point, has an area that is greater than about 20% of a total area of the shaped working surface wherein the working surface comprises an axially asymmetrical curved surface comprising a continuously curving convex portion and concave portions extending from opposite sides of said convex portion, wherein any first point on the peripheral edge intersected by an axial plane extending across the convex portion and the concave portions and through a central axis of said ultrahard material layer is at a level as measured axially from a second point on the convex portion that is at a distance from said first point no less than all levels of the concave portions along said plane as measured axially from said second point.

30. The drill bit of claim 29 wherein the edge is defined by the intersection of a linearly extending surface of the ultrahard material layer and the working surface of said at least one cutter.

31. The bit of claim 29 wherein the peripheral edge is axially asymmetrical.

32. The bit of claim 29 wherein said at least a cutting edge includes a portion of said peripheral edge that is higher than a majority of the remainder of the peripheral edge as measured from the substrate.

33. The earth boring drag bit of claim 29 wherein the convex portion is elongated in plan view and is diametrically symmetrical about a diameter of said cutter spanning a longest span of said convex portion.

34. An earth boring drag type drill bit comprising:

a bit body; and at least one cutter held by the bit body, the at least one cutter having comprising an ultrahard material layer bonded to a substrate, the ultrahard material layer comprising a peripheral side surface and a shaped working surface, said working surface intersecting said peripheral side surface, wherein a peripheral edge is defined by said intersection surrounding said working surface, said peripheral edge forming at least a cutting edge, the shaped working surface including a high point and a low point in an axial direction of the cutter and wherein an imaginary cross-section, taken through the shaped working surface perpendicular to the axial direction of the cutter and halfway between the high point and the low point, has a perimeter length that is greater than about 20% of a total perimeter length of the shaped working surface wherein the working surface comprises an axially asymmetrical curved surface comprising a continuously curving convex portion and concave portions extending from opposite sides of said convex portion, wherein any first point on the peripheral edge intersected by an axial plane extending across the convex portion and the concave portions and through a central axis of said ultrahard material layer is at a level as measured axially from a second point on the convex portion that is at a distance from said first point no less than all levels of the concave portions along said plane as measured axially from said second point.

35. The drill bit of claim 34 wherein the edge is defined by the intersection of a linearly extending surface of the ultrahard material layer and the working surface of said at least one cutter.

36. The bit of claim 34 wherein the peripheral edge is axially asymmetrical.

37. The bit of claim 34 wherein said at least a cutting edge includes a portion of said peripheral edge that is higher than a majority of the remainder of the peripheral edge as measured from the substrate.

38. The earth boring drag bit of claim 34 wherein the convex portion is elongated in plan view and is diametrically symmetrical about a diameter of said cutter spanning a longest span of said convex portion.

39. An earth boring drag type drill bit comprising:

a bit body; and at least one cutter held by the bit body, the at least one cutter having an ultrahard working surface, the working surface including a varied curvature along a critical area of the working surface providing a varied effective back rake angle along a selected critical area of the cutter face, the varied curvature comprising a convex curve portion that connects on one side with a concave curve portion which extends to a side edge and connects on another side with another concave curve portion that extends to another side edge to provide a working surface configured to plow through formation and direct cuttings sideways away from the convex curve portion of the working surface, wherein the curvature of the working surface is varied based upon the intended position of the cutter on the drill bit, and to relatively increase the effective back rake angle in one critical area of the cutter face predicted to have a relatively large depth of cut at the interface with the formation and the curvature is varied to relatively reduce the effective back rake angle of a chamfer in another critical area of the cutter face predicted to have a relatively small depth of cut.

* * * * *

UNITED STATES PATENT AND TRADEMARK OFFICE

CERTIFICATE OF CORRECTION

PATENT NO. : 7,798,257 B2
APPLICATION NO. : 11/117650
DATED : September 21, 2010
INVENTOR(S) : Yuelin Shen et al.

It is certified that error appears in the above-identified patent and that said Letters Patent is hereby corrected as shown below:

In the Claims

| | |
|---|---|
| Column 30, Claim 29, line 64 | Delete "having" |
| Column 31, Claim 34, line 40 | Delete "having" |

Signed and Sealed this
Seventh Day of June, 2011

David J. Kappos

David J. Kappos
*Director of the United States Patent and Trademark Office*